US009590292B2

(12) United States Patent
Li et al.

(10) Patent No.: US 9,590,292 B2
(45) Date of Patent: Mar. 7, 2017

(54) BEAM ANTENNA

(71) Applicant: Industrial Technology Research Institute, Hsinchu (TW)

(72) Inventors: Wei-Yu Li, Yilan County (TW); Tune-Hune Kao, Hsinchu (TW); Meng-Chi Huang, Taoyuan (TW); Wei Chung, Hsinchu County (TW); Min-Chieh Chou, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 14/961,911

(22) Filed: Dec. 8, 2015

(65) Prior Publication Data

US 2016/0164184 A1 Jun. 9, 2016

Related U.S. Application Data

(60) Provisional application No. 62/088,701, filed on Dec. 8, 2014.

(30) Foreign Application Priority Data

Nov. 6, 2015 (TW) ..... 104136638 A

(51) Int. Cl.
*H01Q 9/36* (2006.01)
*H01Q 1/24* (2006.01)
(Continued)

(52) U.S. Cl.
CPC ..... *H01Q 1/243* (2013.01); *H01Q 1/52* (2013.01); *H01Q 9/0442* (2013.01)

(58) Field of Classification Search
CPC ..... H01Q 9/36; H01Q 9/0442; H01Q 1/243; H01Q 1/52
See application file for complete search history.

(56) References Cited

U.S. PATENT DOCUMENTS 3,811,128 A 5/1974 Munson
4,070,676 A 1/1978 Sanford
(Continued)

FOREIGN PATENT DOCUMENTS

CN 101851431 10/2011
CN 202121066 1/2012
(Continued)

OTHER PUBLICATIONS

"Office Action of Taiwan Counterpart Application" , issued on Apr. 21, 2016, p. 1-p. 5.
(Continued)

*Primary Examiner* — Hoang Nguyen
(74) *Attorney, Agent, or Firm* — Jianq Chyun IP Office

(57) ABSTRACT

A beam antenna comprising a first material layer, a second material layer, a first radiating conductor unit and an energy transmission conductor layer is provided. The first material layer has a signal source and a first conductor layer. The second material layer has a first thin-film layer, where the first thin-film layer is adhered on a surface of the second material layer. The first thin-film layer further comprises an insulating gel and a plurality of trigger particles. The first radiating conductor unit is adhered on a surface of the first thin-file layer, and the first thin-file layer is located between the first radiating conductor unit and the second material layer. The energy transmission conductor structure is disposed between the first and the second material layers, which has a first terminal and a second terminal that electrically coupled or connected to the signal source and the first radiating conductor unit respectively.

23 Claims, 10 Drawing Sheets

(51) Int. Cl.
*H01Q 1/52* (2006.01)
*H01Q 9/04* (2006.01)

(56) References Cited

U.S. PATENT DOCUMENTS

| | | | | |
|---|---|---|---|---|
| 4,131,894 | A | 12/1978 | Schiavone | |
| 4,170,013 | A | 10/1979 | Black | |
| 4,835,538 | A | 5/1989 | McKenna et al. | |
| 5,177,486 | A * | 1/1993 | Kim | G01S 7/282 250/214.1 |
| 5,307,075 | A | 4/1994 | Huynh | |
| 5,572,222 | A | 11/1996 | Mailandt et al. | |
| 5,576,073 | A | 11/1996 | Kickelhain | |
| 5,593,739 | A | 1/1997 | Kickelhain | |
| 5,955,179 | A | 9/1999 | Kickelhain et al. | |
| 6,606,061 | B2 | 8/2003 | Wong et al. | |
| 6,696,173 | B1 | 2/2004 | Naundorf et al. | |
| 6,833,511 | B2 | 12/2004 | Uchinono et al. | |
| 6,946,995 | B2 | 9/2005 | Choi et al. | |
| 7,525,506 | B2 | 4/2009 | Wu et al. | |
| 7,666,328 | B2 | 2/2010 | Nair et al. | |
| 7,889,137 | B2 | 2/2011 | Wu et al. | |
| 8,081,138 | B2 | 12/2011 | Wu et al. | |
| 8,373,613 | B2 | 2/2013 | Lin et al. | |
| 8,421,696 | B2 | 4/2013 | Lin et al. | |
| 2004/0026254 | A1 | 2/2004 | Hupe et al. | |
| 2005/0275590 | A1 | 12/2005 | Eom et al. | |
| 2006/0083939 | A1 | 4/2006 | Dunbar et al. | |
| 2010/0026590 | A1 | 2/2010 | Chiang et al. | |
| 2010/0099224 | A1 | 4/2010 | Aoki et al. | |
| 2012/0183793 | A1 | 7/2012 | John et al. | |
| 2013/0048618 | A1 | 2/2013 | van Aalst et al. | |
| 2013/0169499 | A1 | 7/2013 | Lin et al. | |

FOREIGN PATENT DOCUMENTS

| | | |
|---|---|---|
| CN | 102480019 | 5/2012 |
| CN | 203288731 | 11/2013 |
| TW | M463912 | 10/2013 |
| TW | I429136 | 3/2014 |
| WO | 2011134828 | 11/2011 |

OTHER PUBLICATIONS

Thomas Leneke, et al., "A Multilayer Process for the Connection of Fine-Pitch-Devices on Molded Interconnect Devices (MIDS)," Proceedings of IMECE2008, 2008 ASME International Mechanical Engineering Congress and Exposition, Oct. 31-Nov. 6, 2008, pp. 1-8.

Nils Heininger, "3D LDS Components for New Production Opportunities," Microwave Journal, Feb. 14, 2012, pp. 1-4.

Kun-Hsien Lin, et al., "A Novel Planar LHM Radome for Microstrip Antenna," AP-S 2008. IEEE Antennas and Propagation Society International Symposium, Jul. 5-11, 2008, pp. 1-4.

Chih-Yung Lo, et al., "Design of a Novel Planar LHM with Broadband and Double Negative Medium," 2007 IEEE Antennas and Propagation Society International Symposium, Jun. 9-15, 2007, pp. 2582-2585.

Hung-Chi Huang, et al., "Design of Dual-Polarized High-Gain Antenna Radome by Using Jerusalem Cross Metamaterial Structure," APSURSI '09. IEEE Antennas and Propagation Society International Symposium, Jun. 1-5, 2009, pp. 1-4.

Doug Gries, "Photonics Applied: Microelectronics Processing: Laser direct structuring creates low-cost 3D integrated circuits," Laser Focus World, vol. 46, Issue 10, Oct. 1, 2010, available at: http://www.laserfocusworld.com/articles/print/volume-46/issue-10/features/photonics-applied-microelectronics-processing-laser-direct-structuring-creates-low-cost-3d-integrated-circuits.html, pp. 1-8.

Hung-Hsuan Lin, et al., "Metamaterial Enhanced High Gain Antenna for WiMAX Application," TENCON 2007—2007 IEEE Region 10 Conference, Oct. 30-Nov. 2, 2007, pp. 1-3.

Hsing-Nuan Liu, et al., "Design of antenna radome composed of metamaterials for high gain," IEEE Antennas and Propagation Society International Symposium 2006, Jul. 9-14, 2006, pp. 19-22.

Hsin-Lung Su, et al., "Gain-Enhanced Metamaterial Radome for Circularly-Polarized Antenna," 2010 IEEE Antennas and Propagation Society International Symposium (APSURSI), Jul. 11-17, 2010, pp. 1-4.

Ta-Chun Pu, et al., "Photovoltaic Panel as Metamaterial Antenna Radome for Dual-Band Application," Microwave and Optical Technology Letters, vol. 53, No. 10, Oct. 2011, pp. 2382-2388.

Chun-Yih Wu, et al., "Novel High Gain Metamaterial Antenna Radome for WiMAX Operation in the 5.8-GHz band," 2007 IEEE Antennas and Propagation Society International Symposium, Jun. 9-15, 2007, pp. 3488-3491.

Chun-Yih Wu, et al., "High Gain Dual-band Antenna Using Photovoltaic Panel as Metamaterial Superstrate," 2011 IEEE International Symposium on Antennas and Propagation (APSURSI), Jul. 3-8, 2011, pp. 2235-2238.

Chun-Yih Wu, et al., "Planar High Gain Antenna for 5.8-GHz WiMAX Operation," TENCON 2007—2007 IEEE Region 10 Conference, Oct. 30-Nov. 2, 2007, pp. 1-3.

* cited by examiner

BEAM ANTENNA

CROSS-REFERENCE TO RELATED APPLICATION

This application claims the priority benefits of U.S. provisional application Ser. No. 62/088,701, filed on Dec. 8, 2014 and Taiwan application serial no. 104136638, filed on Nov. 6, 2015. The entirety of each of the above-mentioned patent applications is hereby incorporated by reference herein and made a part of this specification.

BACKGROUND OF THE DISCLOSURE

Field of the Disclosure

The disclosure relates to an antenna design capable of improving antenna radiation energy.

Description of Related Art

Along with quick development of wireless communication technology, more and more wireless communication functions are required to be integrated in a single handheld communication device. For example, a wireless wide area network (WWAN) system, a wireless personal area network (WPAN) system, A wireless local area network (WLAN) system, a multi-input multi-output (MIMO) system, a digital television broadcasting (DTV) system, a global positioning system (GPS), a satellite communication system and a beamforming antenna array system, etc.

When antennas of different wireless communication systems have to be integrated into a single handheld communication device with a small internal space, it probably causes attenuation of an antenna radiation characteristic. For example, decrease of antenna far-field radiation efficiency, reduction of antenna pattern maximum gain, increase of antenna energy storage, increase of antenna media and ohmic loss, etc., which greatly increases technical difficulty and challenge in multi-antenna integration of the handheld communication device.

A possible technical resolution of the conventional technique is mainly to design protruding or slit metal structures between antenna elements, or increase a distance between the antenna elements to decrease an energy coupling degree between the antennas. However, these methods may all causes additional increase of a whole size of the multi-antenna system.

SUMMARY OF THE DISCLOSURE

The disclosure is directed to a beam antenna, which has an antenna structure capable of effectively decreasing a medium and ohmic loss, so as to improve a far-field radiation pattern characteristic of a single antenna design.

The disclosure provides a beam antenna. The beam antenna includes a first material layer, a second material layer, at least one first radiating conductor unit and an energy transmission conductor structure. The first material layer has a signal source and a first conductor layer, where the first conductor layer is adhered on a surface of the first material layer, and the signal source is electrically coupled or connected to the first conductor layer. The second material layer has at least one first thin-film layer, where the first thin-film layer is adhered on a surface of the second material layer. The first thin-film layer further includes an insulating gel and a plurality of trigger particles. The insulating gel is a macromolecular material. The trigger particles include at least one of organometallic particles, a chelation, and a semiconductor material with an energy gap greater than or equal to 3 electron-volts (eV). The trigger particles are adapted to be activated when irradiated by a laser energy, where a wavelength of the laser energy is between 430 and 1080 nm. The at least one first radiating conductor unit is adhered on a surface of the first thin-film layer, and the first thin-film layer is located between the first radiating conductor unit and the second material layer. The energy transmission conductor structure is disposed between the first and the second material layers, and has a first terminal and a second terminal. The first terminal is electrically coupled or connected to the signal source, and the second terminal is electrically coupled or connected to the first radiating conductor unit, and excites the beam antenna to generate at least one resonant mode to cover operating frequencies of at least one communication system band.

According to another aspect, the disclosure provides a beam antenna. The beam antenna includes a first material layer, a second material layer, at least one first radiating conductor unit, at least one second radiating conductor unit and an energy transmission conductor structure. The first material layer has a signal source and a first conductor layer, where the first conductor layer is adhered on a surface of the first material layer, and the signal source is electrically coupled or connected to the first conductor layer. The second material layer has a first thin-film layer and a second thin-film layer respectively adhered on different surfaces of the second material layer, and the second material layer is located between the first thin-film layer and the second thin-film layer. The first and second thin-film layers respectively include an insulating gel and a plurality of trigger particles. The insulating gel is a macromolecular material. The trigger particles include at least one of organometallic particles, a metal chelate, and a semiconductor material with an energy gap greater than or equal to 3 electron-volts (eV). The trigger particles are adapted to be activated when irradiated by a laser energy, where a wavelength of the laser energy is between 430 and 1080 nm. The at least one first radiating conductor unit is adhered on a surface of the first thin-film layer, and the first thin-film layer is located between the first radiating conductor unit and the second material layer. The at least one second radiating conductor unit is adhered on a surface of the second thin-film layer, and the second thin-film layer is located between the second material layer and the second radiating conductor unit, and the first radiating conductor unit is electrically coupled or connected to the second radiating conductor unit. The energy transmission conductor structure is disposed between the first and the second material layers, and has a first terminal and a second terminal. The first terminal is electrically coupled or connected to the signal source, and the second terminal is electrically coupled or connected to the first radiating conductor unit, and excites the beam antenna to generate at least one resonant mode to cover operating frequencies of at least one communication system band.

In order to make the aforementioned and other features and advantages of the disclosure comprehensible, several exemplary embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF EMBODIMENTS

The disclosure provides exemplary embodiments of a beam antenna. The beam antenna may adopt a specially designed thin-film layer and conductor layer to effectively enhance antenna far-field radiation efficiency, so as to improve the maximum antenna gain. The beam antenna also adopts specially designed trigger particles of the thin-film layer to effectively decrease parasitic media and ohmic loss of the beam antenna, so as to effectively improve a pattern coverage range of a far-field radiation beam of the beam antenna.

Figure 1:
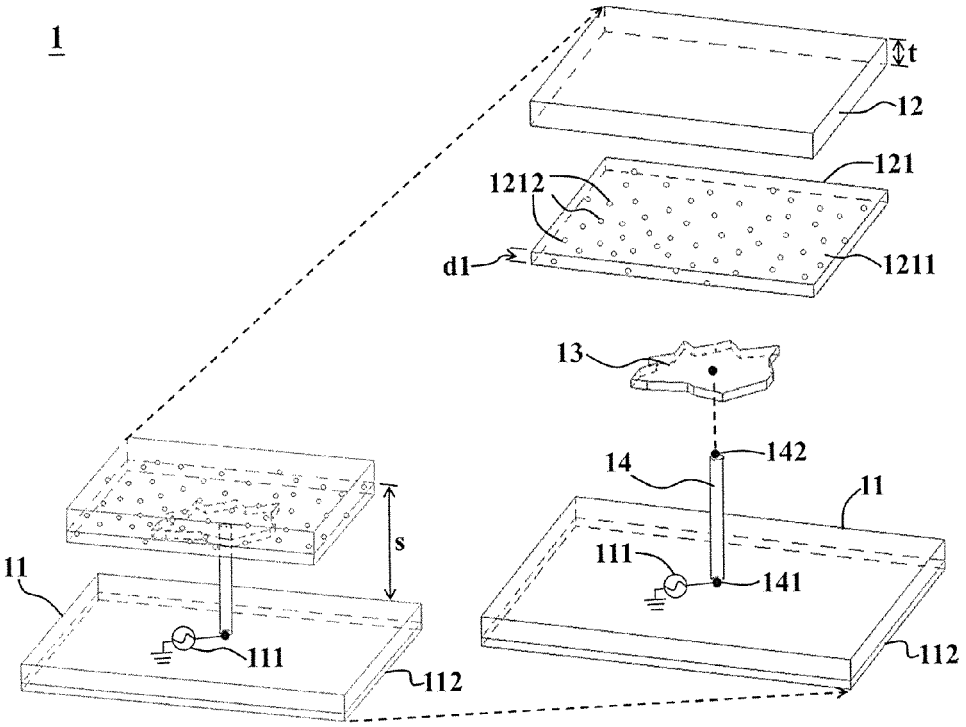
FIG. 1 is a structural schematic diagram of a beam antenna according to an embodiment of the disclosure.

FIG. 1 is a structural schematic diagram of a beam antenna according to an embodiment of the disclosure. As shown in FIG. 1, the beam antenna 1 includes a first material layer 11, a first conductor layer 112, a second material layer 12, at least one first thin-film layer 121, at least one first radiating conductor unit 13 and an energy transmission conductor structure 14. The first material layer 11 has a signal source 111 and the first conductor layer 112, where the first conductor layer 112 is adhered on a surface of the first material layer 11, and the signal source 111 is electrically coupled or connected to the first conductor layer 112. The second material layer 12 has at least one first thin-film layer 121, where the first thin-film layer 121 is adhered on a surface of the second material layer 12. The first thin-film layer 121 includes an insulating gel 1211 and a plurality of trigger particles 1212. The insulating gel 1211 is a macromolecular material. The trigger particles 1212 may be comprised of at least one of organometallic particles, a chelation, and a semiconductor material having an energy gap greater than or equal to 3 electron-volts (eV). The trigger particles 1212 are adapted to be activated when irradiated by a laser energy, where a wavelength of the laser energy is between 430 and 1080 nm. The at least one first radiating conductor unit 13 is adhered on a surface of the first thin-film layer 121, and the first thin-film layer 121 is located between the first radiating conductor unit 13 and the second material layer 12. The energy transmission conductor structure 14 is disposed between the first material layer 11 and the second material layer 12, and has a first terminal 141 and a second terminal 142. The first terminal 141 is electrically coupled or connected to the signal source 111, and the second terminal 142 is electrically coupled or connected to the first radiating conductor unit 13, and excites the beam antenna 1 to generate at least one resonant mode to cover operating frequencies of at least one communication system band.

The beam antenna 1 adopts the specially designed first thin-film layer 121 and the first conductor layer 112 to improve the far-field radiation efficiency of the first radiating conductor unit 13, so as to improve the maximum gain of the beam antenna 1. The beam antenna 1 may also effectively decrease parasitic media and ohmic loss of the first radiating conductor unit 13 by designing a weight percentage of the trigger particles 1212 and the insulating gel 1211 in the first thin-film layer 121, so as to effectively improve a pattern coverage range of a far-field radiation beam of the beam antenna 1. The trigger particles 1212 may constitute 0.1-28 weight percentage of the insulating gel 1211 in the first thin-film layer 121 of the beam antenna 1, and the insulating gel 1211 of the first thin-film layer 121 may have a viscosity less than 9000 centipoises (cP). A thickness t of the second material layer 12 is between 0.001-0.15 times of a wavelength of a minimum operating frequency of the lowest resonant mode generated by the beam antenna 1. A thickness d1 of the first thin-film layer 121 is between 10-290 μm (micrometer). In this way, the parasitic media and ohmic loss of the first radiating conductor unit 13 could be effectively decreased to improve the whole radiation efficiency of the beam antenna 1, so as to effectively increase the pattern coverage range of the far-field radiation beam of the beam antenna 1. A distance s between the first material layer 11 and the second material layer 12 is smaller than 0.39 times of the wavelength of the minimum operating frequency of the lowest resonant mode generated by the beam antenna 1. In this way, a directivity of the beam antenna 1 is enhanced to effectively decrease a transmission loss caused by the energy transmission conductor structure 14, so as to improve the maximum gain of the beam antenna 1.

The trigger particles 1212 of the first thin-film layer 121 in the beam antenna 1 could be a semiconductor material with an energy gap greater than or equal to 3 electron-volts (eV), which is one of gallium nitride (GaN), titanium dioxide ($TiO_2$), aluminum nitride (AlN), silicon dioxide ($SiO_2$), zinc sulfide (ZnS), zinc oxide (ZnO), silicon carbide (SiC), aluminum gallium nitride (AlGaN), aluminum oxide ($Al_2O_3$), boron nitride (BN) or silicon nitride ($Si_3N_4$), or combinations thereof.

Moreover, the trigger particles 1212 of the first thin-film layer 121 in the beam antenna 1 could be organometallic particles having a structure that is R-M-X, R-M-R or R-M-R', where M is a metal, R and R' are a cycloalkyl group, an alkyl group, a heterocycle group or a carboxylic acid group, a alkyl halide group, an aromatic hydrocarbon group, and X is a halogen compound or an amine group. Moreover, M could be one of gold, nickel, tin, copper, palladium, silver or aluminium, or combinations thereof. In this way, the parasitic media and ohmic loss of the first radiating conductor unit 13 could be effectively decreased to improve the radiation efficiency of the beam antenna 1, so as to effectively increase the pattern coverage range of the far-field radiation beam of the beam antenna 1.

The trigger particles 1212 of the first thin-film layer 121 in the beam antenna 1 could also be a chelation, which is formed from a metal chelated by a chelating agent. The chelanting agent is at least one of Ammonium Pyrrolidine Dithiocarbamate (APDC), Ehtylenediaminetetraacetic Acid (EDTA), Nitrilotri Actiate (NTA), N-N'-Bis (Carboxymethyl) Nitrotriacetate or Diethylenetriamine pentaacetic Acid (DTPA), and the metal is one of gold, silver, copper, tin, aluminium, nickel or palladium, or combinations thereof. In this way, the parasitic media and ohmic loss of the first radiating conductor unit 13 could be effectively decreased to improve the radiation efficiency of the beam antenna 1, so as to effectively increase the pattern coverage range of the far-field radiation beam of the beam antenna 1.

The energy transmission conductor structure 14 of the beam antenna 1 could be a pogo-pin feed-in structure, and the energy transmission conductor structure 14 may effectively excite the beam antenna 1 to generate at least one resonant mode to cover operating frequencies of at least one communication system band. The energy transmission conductor structure 14 could also be one of a waveguide structure, a coaxial transmission line structure, a microstrip transmission line structure, a coplanar waveguide structure, a bi-wire transmission line structure, a conductor elastic piece structure or a matching circuit or a combination thereof, which may all achieve the same effect in the beam antenna 1.

Moreover, the signal source 111 of the beam antenna 1 may also be electrically coupled or connected to the first terminal 141 of the energy transmission conductor structure 14 through one of a waveguide structure, a coaxial transmission line structure, a microstrip transmission line structure, a coplanar waveguide structure, a bi-wire transmission line structure, a pogo-pin feed-in structure, a conductor elastic piece structure or a matching circuit or a combination thereof, which may all achieve the same effect in the beam antenna 1.

Moreover, the first radiating conductor unit 13 in the beam antenna 1 may also have one of a patch structure, a short-circuit structure, a meandering structure, a slot structure, a slit structure or a gap structure or a combination thereof, which may all achieve the same effect in the beam antenna 1.

The resonant mode generated by the beam antenna 1 could be designed to cover operating frequencies of a wireless wide area network (WWAN) system, a wireless personal area network (WPAN) system, a wireless local area network (WLAN) system, a multi-input multi-output (MIMO) system, a digital television broadcasting (DTV) system, a global positioning system (GPS), a satellite communication system and a beamforming antenna array system or other wireless or mobile communication system.

Figure 2:
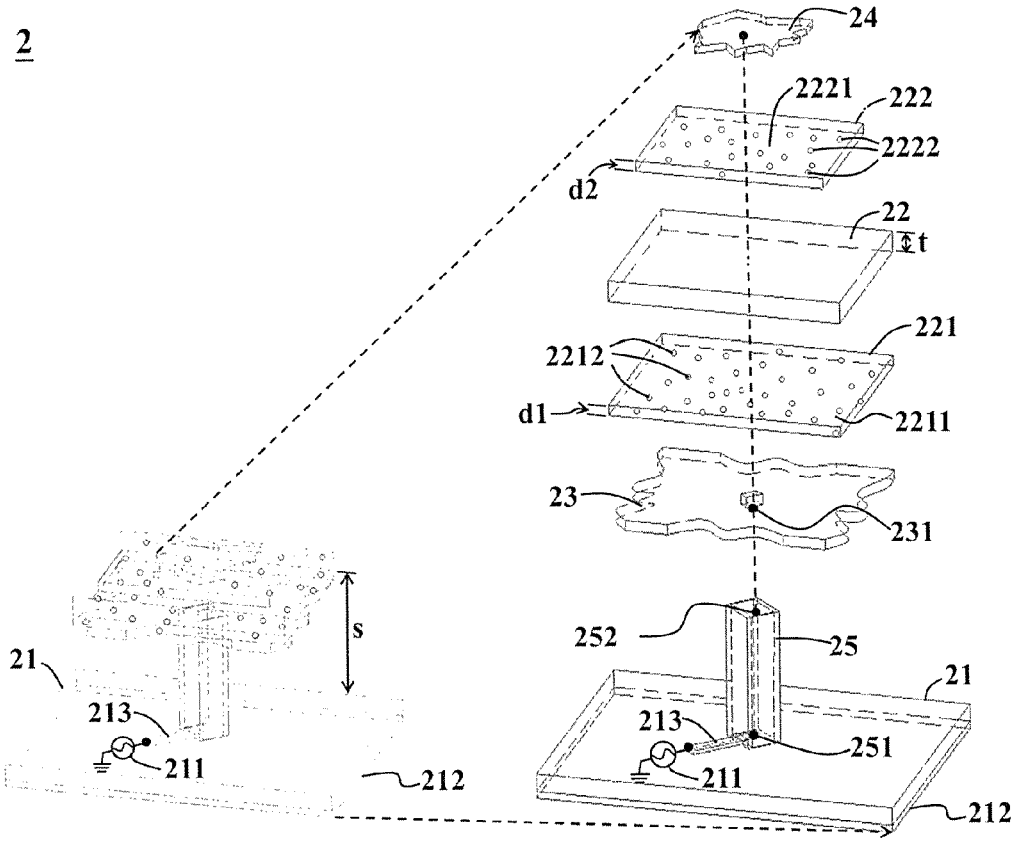
FIG. 2 is a structural schematic diagram of a beam antenna according to another embodiment of the invention.

FIG. 2 is a structural schematic diagram of a beam antenna according to another embodiment of the invention. As shown in FIG. 2, the beam antenna 2 includes a first material layer 21, a first conductor layer 212, a second material layer 22, a first thin-film layer 221, a second thin-film layer 222, at least one first radiating conductor unit 23, at least one second radiating conductor unit 24 and an energy transmission conductor structure 25. The first material layer 21 has a signal source 211 and the first conductor layer 212, where the first conductor layer 212 is adhered on a surface of the first material layer 21, and the signal source 211 is electrically coupled or connected to the first conductor layer 212. The second material layer 22 has the first thin-film layer 221 and the second thin-film layer 222 respectively adhered on different surfaces of the second material layer 22, and the second material layer 22 is located between the first thin-film layer 221 and the second thin-film layer 222. The first thin-film layer 221 and the second thin-film layer 222 respectively include insulating gels 2211, 2221 and a plurality of trigger particles 2212, 2222. The insulating gels 2211 and 2221 are a macromolecular material. The trigger particles 2212 and 2222 may be comprised of at least one of organometallic particles, a chelation, and a semiconductor material having an energy gap greater than or equal to 3 electron-volts (eV) The trigger particles 2212 and 2222 are adapted to be activated when irradiated by a laser energy, where a wavelength of the laser energy is between 430 and 1080 nm. The at least one first radiating conductor unit 23 is adhered on a surface of the first thin-film layer 221, and the first thin-film layer 221 is located between the first radiating conductor unit 23 and the second material layer 22. The at least one second radiating conductor unit 24 is adhered on a surface of the second thin-film layer 222, and the second thin-film layer 222 is located between the second material layer 22 and the second radiating conductor unit 24. The first radiating conductor unit 23 is electrically coupled to the second radiating conductor unit 24 through a slot structure 231. The energy transmission conductor structure 25 is a waveguide structure located between the first material layer 21 and the second material layer 22, and has a first terminal 251 and a second terminal 252. The first terminal 251 is electrically coupled to the signal source 211 through a microstrip transmission line structure 213, and the second terminal 252 is electrically coupled to the slot structure 231 of the first radiating conductor unit 23, and excites the beam antenna 2 to generate at least one resonant mode to cover operating frequencies of at least one communication system band.

The beam antenna 2 adopts the specially designed first and second thin-film layers 221, 222 and the first conductor layer 212 to improve the far-field radiation efficiency of the first and second radiating conductor units 23, 24, so as to improve the maximum gain of the beam antenna 2. The beam antenna 2 may also effectively decrease parasitic media and ohmic loss of the first and second radiating conductor units 23, 24 by designing a weight percentage of the trigger particles 2212, 2222 and the insulating gels 2211, 2221 in the first and second thin-film layers 221, 222, so as to effectively improve the pattern coverage range of the far-field radiation beam of the beam antenna 2. The trigger particles 2212, 2222 may constitute 0.1-28 of the insulating gels 2211, 2221 in the first and second thin-film layers 221, 222 of the beam antenna 2, and the insulating gels 2211, 2221 of the first and second thin-film layers 221, 222 may have a viscosity less than 9000 centipoises (cP). A thickness t of the second material layer 22 is between 0.001-0.15 times of a wavelength of a minimum operating frequency of the lowest resonant mode generated by the beam antenna 2. Thickness d1 and d2 of the first and second thin-film layers 221, 222 are all between 10-290 μm. In this way, the parasitic media and ohmic loss of the first and second radiating conductor units 23, 24 could be effectively decreased to improve the whole radiation efficiency of the beam antenna 2, so as to effectively increase the pattern coverage range of the far-field radiation beam of the beam antenna 2. A distance s between the first material layer 21 and the second material layer 22 is smaller than 0.39 times of the wavelength of the minimum operating frequency of the lowest resonant mode generated by the beam antenna 2. In this way, the radiation directivity of the beam antenna 2 would be enhanced to effectively decrease a transmission loss caused by the energy transmission conductor structure 25, so as to improve the maximum gain of the beam antenna 2.

The trigger particles 2212, 2222 of the first and second thin-film layers 221, 222 in the beam antenna 2 could be a semiconductor material with an energy gap greater than or equal to 3 eV, which is one of gallium nitride (GaN), titanium dioxide ($TiO_2$), aluminum nitride (AlN), silicon dioxide ($SiO_2$), zinc sulfide (ZnS), zinc oxide (ZnO), silicon carbide (SiC), aluminum gallium nitride (AlGaN), aluminum oxide ($Al_2O_3$), boron nitride (BN) or silicon nitride ($Si_3N_4$), or combinations thereof. Moreover, the trigger particles 2212, 2222 of the first and second thin-film layers 221, 222 in the beam antenna 2 could be organometallic particles having a structure that is R-M-X, R-M-R or R-M-R', in which M is a metal, R and R' are a cycloalkyl group, an alkyl group, a heterocycle group or a carboxylic acid group, a alkyl halide group, an aromatic hydrocarbon group, and X is a halogen compound or an amine group. Moreover, M could be one of gold, nickel, tin, copper, palladium, silver or aluminium, or combinations thereof. In this way, the parasitic media and ohmic loss of the first and second radiating conductor units 23, 24 could be effectively decreased to improve the radiation efficiency of the beam antenna 2, so as to effectively increase the pattern coverage range of the far-field radiation beam of the beam antenna 2.

The trigger particles 2212, 2222 of the first and second thin-film layers 221, 222 in the beam antenna 2 could also be a chelation, which is formed from a metal chelated by a chelating agent. The chelanting agent is at least one of Ammonium Pyrrolidine Dithiocarbamate (APDC), Ehtylenediaminetetraacetic Acid (EDTA), Nitrilotri Actiate (NTA), N-N'-Bis (Carboxymethyl) Nitrotriacetate or Diethylenetriamine pentaacetic Acid (DTPA), and the metal is one of gold, silver, copper, tin, aluminium, nickel or palladium, or combinations thereof. In this way, the parasitic media and ohmic loss of the first and second radiating conductor units 23, 24 can be effectively decreased to improve the radiation efficiency of the beam antenna 2, so as to effectively increase the pattern coverage range of the far-field radiation beam of the beam antenna 2.

Compared to the beam antenna 1, in the beam antenna 2, although the second thin-film layer 222 and the second radiating conductor unit 24 are additionally configured on another surface of the second material layer 22, the beam antenna 2 also effectively decreases parasitic media and ohmic loss of the first and second radiating conductor units 23, 24 by designing the weight percentage of the trigger particles 2212, 2222 and the insulating gels 2211, 2221 in the first and second thin-film layers 221, 222, so as to effectively improve the pattern coverage range of the far-field radiation beam of the beam antenna 2. The beam antenna 2 may also effectively decrease the stray parasitic media and ohmic loss of the first and second radiating conductor units 23, 24 through the thickness d1 and d2 of the first and second thin-film layers 221, 222, so as to improve the whole radiation efficiency of the beam antenna 2. Moreover, the beam antenna 2 may also enhance the directivity of the beam antenna 2 through the distance s between the first material layer 21 and the second material layer 22, so as to effectively decrease the transmission loss caused by the energy transmission conductor structure 25, and improve the maximum gain of the beam antenna 2. Therefore, the beam antenna 2 may also achieve the similar effect as that of the beam antenna 1.

The energy transmission conductor structure 25 of the beam antenna 2 could be a waveguide structure, which may effectively excite the beam antenna 2 to generate at least one resonant mode to cover operating frequencies of at least one communication system band. The energy transmission conductor structure 25 could also be one of a pogo-pin feed-in structure, a coaxial transmission line structure, a microstrip transmission line structure, a coplanar waveguide structure, a bi-wire transmission line structure, a conductor elastic piece structure or a matching circuit or a combination thereof, which may all achieve the same effect in the beam antenna 2.

The signal source 211 of the beam antenna 2 is electrically coupled or connected to the first terminal 251 of the energy transmission conductor structure 25 through a microstrip transmission line structure 213. However, the signal source 211 could also be electrically coupled or connected to the first terminal 251 of the energy transmission conductor structure 25 through one of a waveguide structure, a coaxial transmission line structure, a coplanar waveguide structure, a bi-wire transmission line structure, a pogo-pin feed-in structure, a conductor elastic piece structure or a matching circuit or a combination thereof, which may all achieve the same effect in the beam antenna 2.

Moreover, in the beam antenna 2, the first radiating conductor unit 23 is electrically coupled to the second radiating conductor unit 24 through a slot structure 231. However, the first radiating conductor unit 23 may also be electrically coupled or connected to the second radiating conductor unit 24 through one of a waveguide structure, a microstrip transmission line structure, a coplanar waveguide structure, a bi-wire transmission line structure, a via-hole conducting structure, or a matching circuit or a combination thereof, which may all achieve the same effect in the beam antenna 2.

The first and second radiating conductor units 23, 24 in the beam antenna 2 may also have one of a patch structure, a short-circuit structure, a meandering structure, a slot structure, a slit structure or a gap structure or a combination thereof, which may all achieve the same effect in the beam antenna 2.

The resonant mode generated by the beam antenna 2 can be designed to cover a frequency band operation of a wireless wide area network (WWAN) system, a wireless personal area network (WPAN) system, a wireless local area network (WLAN) system, a multi-input multi-output (MIMO) system, a digital television broadcasting (DTV) system, a global positioning system (GPS), a satellite communication system and a beamforming antenna array system or other wireless or mobile communication systems.

Figure 3:
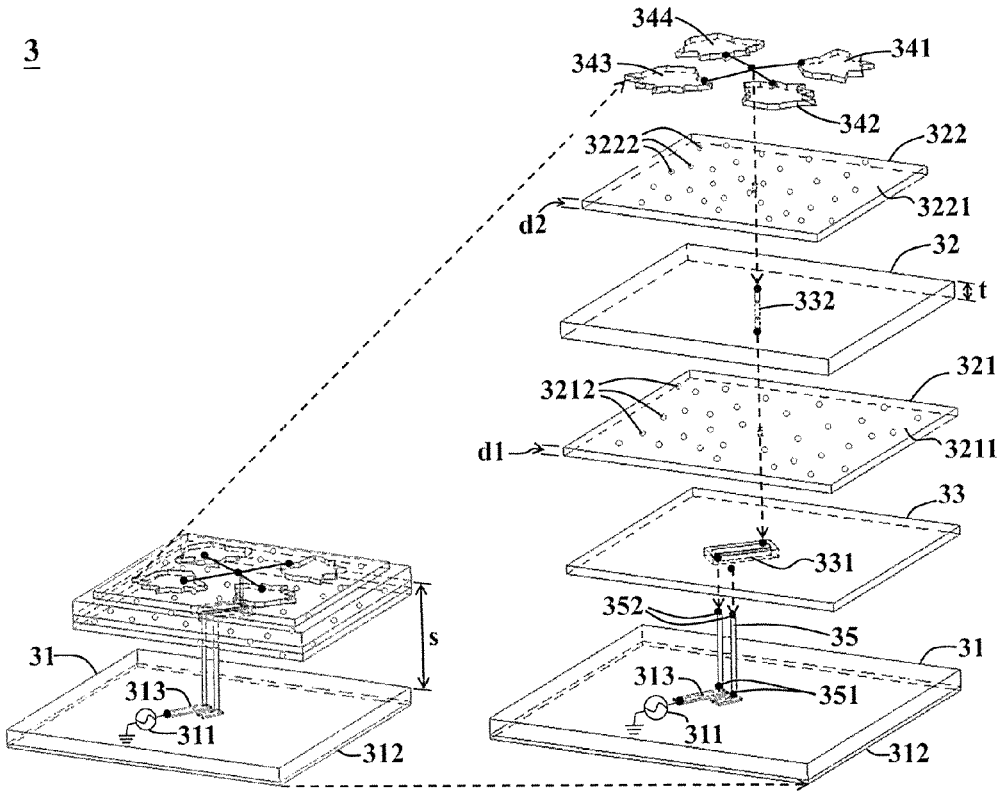
FIG. 3 is a structural schematic diagram of a beam antenna according to still another embodiment of the invention.

FIG. 3 is a structural schematic diagram of a beam antenna according to still another embodiment of the invention. As shown in FIG. 3, the beam antenna 3 includes a first material layer 31, a first conductor layer 312, a second material layer 32, a first thin-film layer 321, a second thin-film layer 322, at least one first radiating conductor unit 33, a plurality of second radiating conductor units 341, 342, 343, 344 and an energy transmission conductor structure 35. The first material layer 31 has a signal source 311 and the first conductor layer 312, where the first conductor layer 312 is adhered on a surface of the first material layer 31, and the signal source 311 is electrically coupled or connected to the first conductor layer 312. The second material layer 32 has the first thin-film layer 321 and the second thin-film layer 322 respectively adhered on different surfaces of the second material layer 32, and the second material layer 32 is located between the first thin-film layer 321 and the second thin-film layer 322. The first thin-film layer 321 and the second thin-film layer 322 respectively include insulating gels 3211, 3221 and a plurality of trigger particles 3212, 3222. The insulating gels 3211 and 3221 are a macromolecular material. The trigger particles 3212 and 3222 include at least one of organometallic particles, a chelation, and a semiconductor material with an energy gap greater than or equal to 3 eV. The trigger particles 3212 and 3222 are adapted to be activated when irradiated by laser energy, where a wavelength of the laser energy is between 430 and 1080 nm. The at least one first radiating conductor unit 33 is adhered on a surface of the first thin-film layer 321, and the first thin-film layer 321 is located between the first radiating conductor unit 33 and the second material layer 32. The plurality of second radiating conductor units 341, 342, 343, 344 are adhered on a surface of the second thin-film layer 322, and the second thin-film layer 322 is located between the second material layer 32 and the plurality of second radiating conductor units 341, 342, 343, 344. The first radiating conductor unit 33 is electrically coupled to the plurality of second radiating conductor units 341, 342, 343, 344 through a coplanar waveguide structure 331 and a via-hole conducting structure 332. The second radiating conductor units 341, 342, 343, 344 are electrically connected to each other. The energy transmission conductor structure 35 is a bi-wire transmission line structure located between the first material layer 31 and the second material layer 32, and has a first terminal 351 and a second terminal 352. The first terminal 351 is electrically coupled to the signal source 211 through a microstrip transmission line structure 313, and the second terminal 352 is electrically coupled to the coplanar waveguide structure 331 of the first radiating conductor unit 33, and excites the beam antenna 3 to generate at least one resonant mode to cover operating frequencies of at least one communication system band.

The beam antenna 3 adopts the specially designed first and second thin-film layers 321, 322 and the first conductor layer 312 to improve the far-field radiation efficiency of the first radiating conductor unit 33 and the second radiating conductor units 341, 342, 343 and 344, so as to improve the maximum gain of the beam antenna 3. The beam antenna 3 may also effectively decrease parasitic media and ohmic loss of the first radiating conductor unit 33 and the second radiating conductor units 341, 342, 343 and 344 by designing a weight percentage of the trigger particles 3212, 3222 and the insulating gels 3211, 3221 in the first and second thin-film layers 321, 322, so as to effectively improve the pattern coverage range of the far-field radiation beam of the beam antenna 3. The trigger particles 3212, 3222 may institute 0.1-28 weight percentage of the insulating gels 3211, 3221 in the first and second thin-film layers 321, 322 of the beam antenna 3, and the insulating gels 3211, 3221 of the first and second thin-film layers 321, 322 may have a viscosity smaller than 9000 cP. A thickness t of the second material layer 32 is between 0.001-0.15 times of a wavelength of a minimum operating frequency of the lowest resonant mode generated by the beam antenna 3. Thickness d1 and d2 of the first and second thin-film layers 321, 322 are all between 10-290 μm. In this way, the parasitic media and ohmic loss of the first radiating conductor unit 33 and the second radiating conductor units 341, 342, 343 and 344 could be effectively decreased to improve the whole radiation efficiency of the beam antenna 3, so as to effectively increase the pattern coverage range of the far-field radiation beam of the beam antenna 3. A distance s between the first material layer 31 and the second material layer 32 is smaller than 0.39 times of the wavelength of the minimum operating frequency of the lowest resonant mode generated by the beam antenna 3. In this way, the radiation directivity of the beam antenna 3 is enhanced to effectively decrease a transmission loss caused by the energy transmission conductor structure 35, so as to improve the maximum gain of the beam antenna 3.

The trigger particles 3212, 3222 of the first and second thin-film layers 321, 322 in the beam antenna 3 could be a semiconductor material with an energy gap greater than or equal to 3 eV, which is one of gallium nitride (GaN), titanium dioxide ($TiO_2$), aluminum nitride (AlN), silicon dioxide ($SiO_2$), zinc sulfide (ZnS), zinc oxide (ZnO), silicon carbide (SiC), aluminum gallium nitride (AlGaN), aluminum oxide ($Al_2O_3$), boron nitride (BN) or silicon nitride ($Si_3N_4$), or combinations thereof. Moreover, the trigger particles 3212, 3222 of the first and second thin-film layers 321, 322 in the beam antenna 3 could be organometallic particles, where a structure of the organometallic particle is R-M-X, R-M-R or R-M-R', in which M is metal, R and R' are a cycloalkyl group, an alkyl group, a heterocycle group or a carboxylic acid group, a alkyl halide group, an aromatic hydrocarbon group, and X is a halogen compound or an amine group. Moreover, M could be one of gold, nickel, tin, copper, palladium, silver or aluminium, or combinations thereof. In this way, the parasitic media and ohmic loss of the first radiating conductor unit 33 and the second radiating conductor units 341, 342, 343 and 344 could be effectively decreased to improve the radiation efficiency of the beam antenna 3, so as to effectively increase the pattern coverage range of the far-field radiation beam of the beam antenna 3.

The trigger particles 3212, 3222 of the first and second thin-film layers 321, 322 in the beam antenna 3 could also be a chelation, which is formed from a metal chelated by a chelating agent. The chelating agent is at least one of Ammonium Pyrrolidine Dithiocarbamate (APDC), Ehtylenediaminetetraacetic Acid (EDTA), Nitrilotri Actiate (NTA), N-N'-Bis (Carboxymethyl) Nitrotriacetate or Diethylenetriamine pentaacetic Acid (DTPA), and the metal is one of gold, silver, copper, tin, aluminium, nickel or palladium, or combinations thereof. In this way, the parasitic media and ohmic loss of the first radiating conductor unit 33 and the second radiating conductor units 341, 342, 343 and 344 could be effectively decreased to improve the radiation efficiency of the beam antenna 3, so as to effectively increase the pattern coverage range of the far-field radiation beam of the beam antenna 3.

Compared to the beam antenna 2, the beam antenna 3 is configured with a plurality of the second radiating conductor units 341, 342, 343 and 344. However, the beam antenna 3 also effectively decreases parasitic media and ohmic loss of the first radiating conductor unit 33 and the second radiating conductor units 341, 342, 343 and 344 by designing the weight percentage of the trigger particles 3212, 3222 and the insulating gels 3211, 3221 in the first and second thin-film layers 321, 322, so as to effectively improve the pattern coverage range of the far-field radiation beam of the beam antenna 3. The beam antenna 3 may also effectively decrease the parasitic media and ohmic loss of the first radiating conductor unit 33 and the second radiating conductor units 341, 342, 343 and 344 through the thickness d1 and d2 of the first and second thin-film layers 321, 322, so as to improve the whole radiation efficiency of the beam antenna 3. Moreover, the beam antenna 3 may also enhance the directivity of the beam antenna 3 through the distance s between the first material layer 31 and the second material layer 32, so as to effectively decrease the transmission loss caused by the energy transmission conductor structure 35, and improve the maximum gain of the beam antenna 3. Therefore, the beam antenna 3 may also achieve the similar effect as that of the beam antenna 2.

The energy transmission conductor structure 35 of the beam antenna 3 is a bi-wire transmission line structure, which may effectively excite the beam antenna 3 to generate at least one resonant mode to cover operating frequencies of at least one communication system band. The energy transmission conductor structure 35 could also be one of a pogo-pin feed-in structure, a coaxial transmission line structure, a microstrip transmission line structure, a coplanar waveguide structure, a waveguide structure, a conductor elastic piece structure or a matching circuit or a combination thereof, which may all achieve the same effect in the beam antenna 3.

The signal source 311 of the beam antenna 3 is electrically coupled or connected to the first terminal 351 of the energy transmission conductor structure 35 through a microstrip transmission line structure 313. However, the signal source 311 could also be electrically coupled or connected to the first terminal 351 of the energy transmission conductor structure 35 through one of a waveguide structure, a coaxial transmission line structure, a coplanar waveguide structure, a bi-wire transmission line structure, a pogo-pin feed-in structure, a conductor elastic piece structure or a matching circuit or a combination thereof, which may all achieve the same effect in the beam antenna 3.

Moreover, in the beam antenna 3, the first radiating conductor unit 33 is electrically coupled to the second radiating conductor units 341, 342, 343 and 344 through a coplanar waveguide structure 331 and a via-hole conducting structure 332. However, the first radiating conductor unit 33 may also be electrically coupled or connected to the second radiating conductor units 341, 342, 343 and 344 through one of a waveguide structure, a microstrip transmission line structure, a slot structure, a bi-wire transmission line structure or a matching circuit or a combination thereof, which may all achieve the same effect in the beam antenna 3.

The first radiating conductor units 33 and the second radiating conductor units 341, 342, 343 and 344 in the beam antenna 3 may also have one of a patch structure, a short-circuit structure, a meandering structure, a slot structure, a slit structure or a gap structure or a combination thereof, which may all achieve the same effect in the beam antenna 3.

Figure 4:
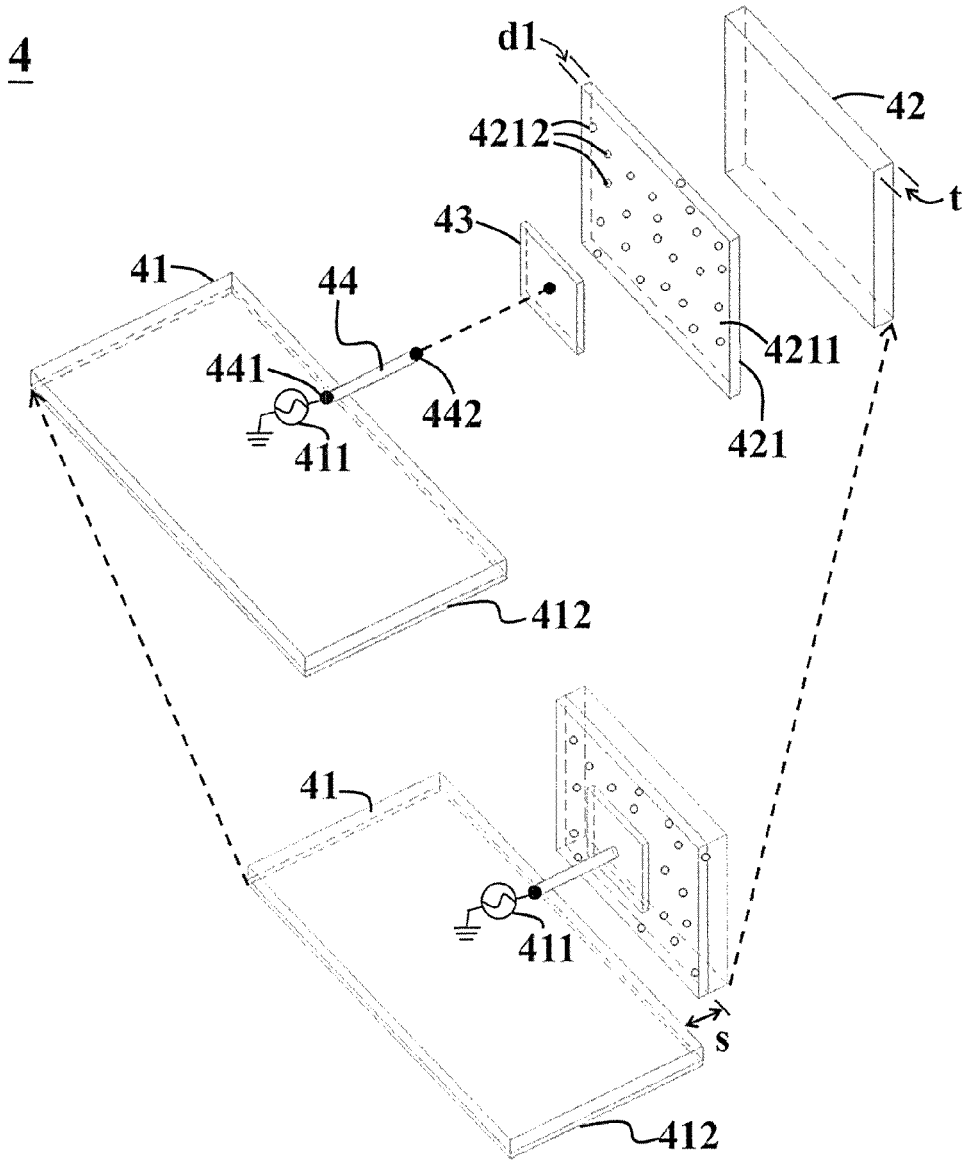
FIG. 4 is a structural schematic diagram of a beam antenna according to still another embodiment of the invention.

FIG. 4 is a structural schematic diagram of a beam antenna according to still another embodiment of the invention. As shown in FIG. 4, the beam antenna 4 includes a first material layer 41, a first conductor layer 412, a second material layer 42, at least one first thin-film layer 421, at least one first radiating conductor unit 43 and an energy transmission conductor structure 44. The first material layer 41 has a signal source 411 and the first conductor layer 412, where the first conductor layer 412 is adhered on a surface of the first material layer 41, and the signal source 411 is electrically coupled or connected to the first conductor layer 412. The second material layer 42 has at least one first thin-film layer 421, where the first thin-film layer 421 is adhered on a surface of the second material layer 42. The first thin-film layer 421 includes an insulating gel 4211 and a plurality of trigger particles 4212. The insulating gel 4211 is a macromolecular material. The trigger particles 4212 include at least one of organometallic particles, a chelation, and a semiconductor material with an energy gap greater than or equal to 3 eV. The trigger particles 4212 are adapted to be activated when irradiated by a laser energy, where a wavelength of the laser energy is between 430 and 1080 nm. The at least one first radiating conductor unit 43 is adhered on a surface of the first thin-film layer 421, and the first thin-film layer 421 is located between the first radiating conductor unit 43 and the second material layer 42. The energy transmission conductor structure 44 is a pogo-pin feed-in structure, which is disposed between the first material layer 41 and the second material layer 42, and has a first terminal 441 and a second terminal 442. The first terminal 441 is electrically connected to the signal source 411, and the second terminal 442 is electrically connected to the first radiating conductor unit 43, and excites the beam antenna 4 to generate at least one resonant mode to cover operating frequencies of at least one communication system band.

The beam antenna 4 adopts the specially designed first thin-film layer 421 and the first conductor layer 412 to improve the far-filed radiation efficiency of the first radiating conductor unit 43, so as to improve the maximum gain of the beam antenna 4. The beam antenna 4 may also effectively decrease parasitic media and ohmic loss of the first radiating conductor unit 43 by designing a weight percentage of the trigger particles 4212 and the insulating gel 4211 in the first thin-film layer 421, so as to effectively improve the pattern coverage range of the far-field radiation beam of the beam antenna 4. The trigger particles 4212 may constitute 0.1-28 weight percentage of the insulating gel 4211 in the first thin-film layer 421 of the beam antenna 4, and the insulating gel 4211 of the first thin-film layer 421 may have a viscosity smaller than 9000 cP. A thickness t of the second material layer 42 is between 0.001-0.15 times of a wavelength of the minimum operation frequency of the resonant mode generated by the beam antenna 4. A thickness d1 of the first thin-film layer 421 is between 10-290 μm. In this way, the parasitic media and ohmic loss of the first radiating conductor unit 43 couls be effectively decreased to improve the whole radiation efficiency of the beam antenna 4, so as to effectively increase the pattern coverage range of the far-field radiation beam of the beam antenna 4. A distance s between the first material layer 41 and the second material layer 42 is smaller than 0.39 times of the wavelength of the minimum operating frequency of the lowest resonant mode generated by the beam antenna 4. In this way, the directivity of the beam antenna 4 is enhanced to effectively decrease a transmission loss caused by the energy transmission conductor structure 44, so as to improve the maximum gain of the beam antenna 4.

The trigger particles 4212 of the first thin-film layer 421 in the beam antenna 4 can be a semiconductor material with an energy gap greater than or equal to 3 eV, which is one of gallium nitride (GaN), titanium dioxide ($TiO_2$), aluminum nitride (AlN), silicon dioxide ($SiO_2$), zinc sulfide (ZnS), zinc oxide (ZnO), silicon carbide (SiC), aluminum gallium nitride (AlGaN), aluminum oxide ($Al_2O_3$), boron nitride (BN) or silicon nitride ($Si_3N_4$), or combinations thereof. Moreover, the trigger particles 4212 of the first thin-film layer 421 in the beam antenna 4 could be organometallic particles, where a structure of the organometallic particle is R-M-X, R-M-R' or R-M-R, in which M is metal, R and R' could be a cycloalkyl group, an alkyl group, a heterocycle group or a carboxylic acid group, a alkyl halide group, an aromatic hydrocarbon group, and X is a halogen compound or an amine group. Moreover, M could be one of gold, nickel, tin, copper, palladium, silver or aluminium, or combinations thereof. In this way, the parasitic media and ohmic loss of the first radiating conductor unit 43 could be effectively decreased to improve the radiation efficiency of the beam antenna 4, so as to effectively increase the pattern coverage range of the far-field radiation beam of the beam antenna 4.

The trigger particles 4212 of the first thin-film layer 421 in the beam antenna 4 could also be a chelation, which is formed from a metal chelated by a chelating agent. The chelanting agent is at least one of Ammonium Pyrrolidine Dithiocarbamate (APDC), Ehtylenediaminetetraacetic Acid (EDTA), Nitrilotri Actiate (NTA), N-N'-Bis (Carboxymethyl) Nitrotriacetate or Diethylenetriamine pentaacetic Acid (DTPA), and the metal could be one of gold, silver, copper, tin, aluminium, nickel or palladium, or combinations thereof. In this way, the parasitic media and ohmic loss of the first radiating conductor unit 43 could be effectively decreased to improve the radiation efficiency of the beam antenna 4, so as to effectively increase the pattern coverage range of the far-field radiation beam of the beam antenna 4.

Compared to the beam antenna 1, in the beam antenna 4, although a configuration direction of the second material layer 42, the first thin-film layer 421 and the first radiating conductor unit 43 is different to that of the beam antenna 1, the beam antenna 4 also effectively decreases parasitic media and ohmic loss of the first radiating conductor unit 43 by designing the weight percentage of the trigger particles 4212 and the insulating gel 4211 in the first thin-film layer 421, so as to effectively improve the pattern coverage range of the far-field radiation beam of the beam antenna 4. The beam antenna 4 may also effectively decrease the parasitic media and ohmic loss of the first radiating conductor unit 43 through the thickness d1 of the first thin-film layer 421, so as to improve the whole radiation efficiency of the beam antenna 4. Moreover, the beam antenna 4 may also enhance the directivity of the beam antenna 4 through the distance s between the first material layer 41 and the second material layer 42, so as to effectively decrease the transmission loss caused by the energy transmission conductor structure 44, and improve the maximum gain of the beam antenna 4. Therefore, the beam antenna 4 may also achieve the similar effect as that of the beam antenna 1.

The energy transmission conductor structure 44 of the beam antenna 4 is a pogo-pin feed-in structure, and the energy transmission conductor structure 44 may effectively excite the beam antenna 4 to generate at least one resonant mode to cover operating frequencies of at least one communication system band. The energy transmission conductor structure 44 could also be one of a waveguide structure, a coaxial transmission line structure, a microstrip transmission line structure, a coplanar waveguide structure, a bi-wire transmission line structure, a conductor elastic piece structure or a matching circuit or a combination thereof, which may all achieve the same effect in the beam antenna 4.

Moreover, the signal source 411 of the beam antenna 4 may also be electrically coupled or connected to the first terminal 441 of the energy transmission conductor structure 44 through one of a waveguide structure, a coaxial transmission line structure, a microstrip transmission line structure, a coplanar waveguide structure, a bi-wire transmission line structure, a pogo-pin feed-in structure, a conductor elastic piece structure or a matching circuit or a combination thereof, which may all achieve the same effect in the beam antenna 4.

Moreover, the first radiating conductor unit 43 in the beam antenna 4 may also have one of a patch structure, a short-circuit structure, a meandering structure, a slot structure, a slit structure or a gap structure or a combination thereof, which may all achieve the same effect in the beam antenna 4.

Figure 5A:
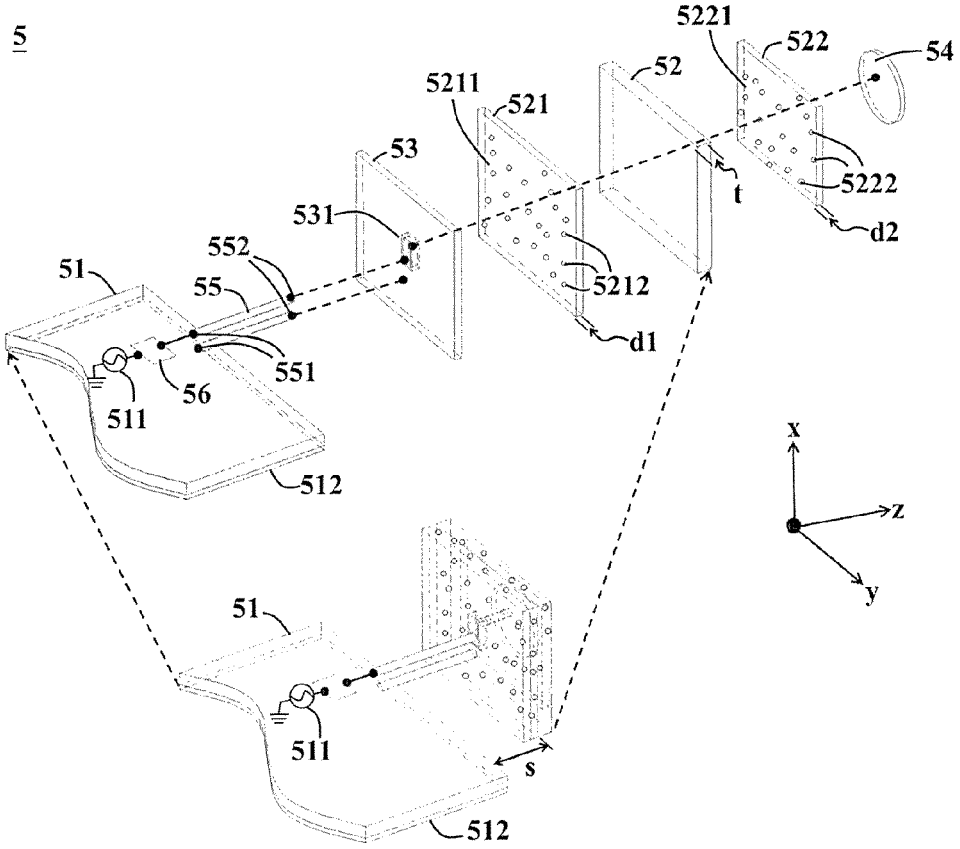
FIG. 5A is a structural schematic diagram of a beam antenna according to still another embodiment of the invention.

FIG. 5A is a structural schematic diagram of a beam antenna according to still another embodiment of the invention. As shown in FIG. 5A, the beam antenna 5 includes a first material layer 51, a first conductor layer 512, a second material layer 52, a first thin-film layer 521, a second thin-film layer 522, at least one first radiating conductor unit 53, at least one second radiating conductor unit 54 and an energy transmission conductor structure 55. The first material layer 51 has a signal source 511 and the first conductor layer 512, where the first conductor layer 512 is adhered on a surface of the first material layer 51, and the signal source 511 is electrically coupled or connected to the first conductor layer 512. The second material layer 52 has the first thin-film layer 521 and the second thin-film layer 522 respectively adhered on different surfaces of the second material layer 52, and the second material layer 52 is located between the first thin-film layer 521 and the second thin-film layer 522. The first thin-film layer 521 and the second thin-film layer 522 respectively include insulating gels 5211, 5221 and a plurality of trigger particles 5212, 5222. The insulating gels 5211 and 5221 are a macromolecular material. The trigger particles 5212 and 5222 include at least one of organometallic particles, a chelation, and a semiconductor material with an energy gap greater than or equal to 3 eV. The trigger particles 5212 and 5222 are adapted to be activated when irradiated by a laser energy, where a wavelength of the laser energy is between 430 and 1080 nm. The at least one first radiating conductor unit 53 is adhered on a surface of the first thin-film layer 521, and the first thin-film layer 521 is located between the first radiating conductor unit 53 and the second material layer 52. The at least one second radiating conductor unit 54 is adhered on a surface of the second thin-film layer 522, and the second thin-film layer 522 is located between the second material layer 52 and the second radiating conductor unit 54. The first radiating conductor unit 53 is electrically coupled to the second radiating conductor unit 54 through a coplanar waveguide structure 531. The energy transmission conductor structure 55 is a waveguide structure located between the first material layer 51 and the second material layer 52, and has a first terminal 551 and a second terminal 552. The first terminal 551 is electrically coupled to the signal source 511 through a matching circuit 56, and the second terminal 552 is electrically coupled to the coplanar waveguide structure 531 of the first radiating conductor unit 53, and excites the beam antenna 5 to generate at least one resonant mode to cover operating frequencies of at least one communication system band.

Figure 5B:
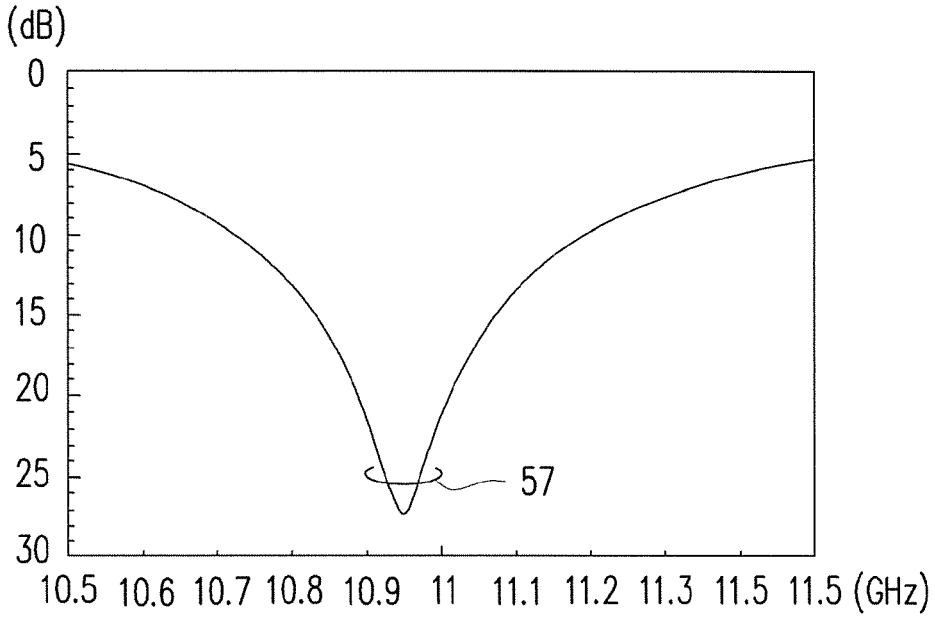
FIG. 5B is a return loss diagram of the beam antenna of FIG. 5A.
Figure 5C:
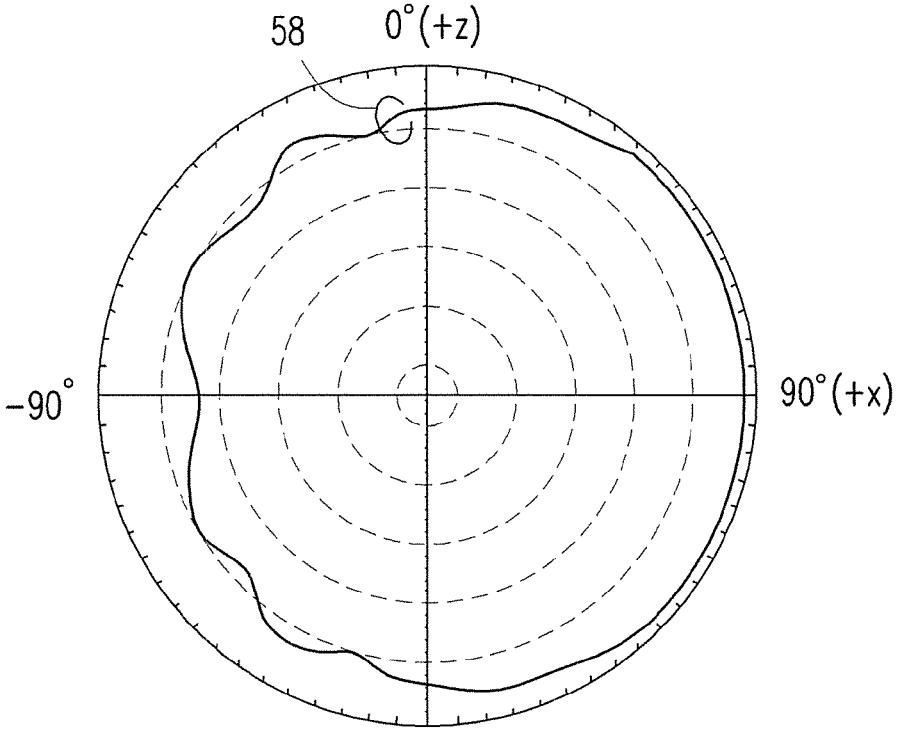
FIG. 5C is a diagram illustrating a main beam radiation pattern of the beam antenna of FIG. 5A.

FIG. 5B is a return loss diagram of the beam antenna of FIG. 5A. As shown in FIG. 5B, the beam antenna 5 generates at least one resonant mode 57 to cover operating frequencies of a communication system of 11 GHz. FIG. 5C is a diagram illustrating a main beam radiation pattern 58 of the beam antenna of FIG. 5A. FIG. 5B is only an example for the at least one resonant mode generated by the beam antenna 5 covering operating frequencies of at least one communication system band, which is not used for limiting the implementation of the invention. The resonant mode generated by the beam antenna 5 could also be designed to cover operating frequencies of a wireless wide area network (WWAN) system, a wireless personal area network (WPAN) system, a wireless local area network (WLAN) system, a multi-input multi-output (MIMO) system, a digital television broadcasting (DTV) system, a global positioning system (GPS), a satellite communication system and a beam-forming antenna array system or other wireless or mobile communication systems.

The beam antenna 5 adopts the specially designed first and second thin-film layers 521, 522 and the first conductor layer 512 to improve the far-field radiation efficiency of the first and second radiating conductor units 53, 54, so as to improve the maximum gain of the beam antenna 5. The beam antenna 5 may also effectively decrease parasitic media and ohmic loss of the first and second radiating conductor units 53, 54 by designing a weight percentage of the trigger particles 5212, 5222 and the insulating gels 5211, 5221 in the first and second thin-film layers 521, 522, so as to effectively improve the pattern coverage range of the far-field radiation beam of the beam antenna 5. The trigger particles 5212, 5222 may constitute 0.1-28 weight percentage of the insulating gels 5211, 5221 in the first and second thin-film layers 521, 522 of the beam antenna 5, and the insulating gels 5211, 5221 of the first and second thin-film layers 521, 522 may have a viscosity less than 9000 cP. A thickness t of the second material layer 52 is between 0.001-0.15 times of a wavelength of a minimum operating frequency of the lowest resonant mode generated by the beam antenna 5. Thickness d1 and d2 of the first and second thin-film layers 521, 522 are all between 10-290 μm. In this way, the parasitic media and ohmic loss of the first and second radiating conductor units 53, 54 could be effectively decreased to improve the whole radiation efficiency of the beam antenna 5, so as to effectively increase the pattern coverage range of the far-field radiation beam of the beam antenna 5. A distance s between the first material layer 51 and the second material layer 52 is smaller than 0.39 times of the wavelength of the minimum operating frequency of the lowest resonant mode generated by the beam antenna 5. In this way, a directivity of the beam antenna 5 is enhanced to effectively decrease a transmission loss caused by the energy transmission conductor structure 55, so as to improve the maximum gain of the beam antenna 5.

The trigger particles 5212, 5222 of the first and second thin-film layers 521, 522 in the beam antenna 5 could be a semiconductor material with an energy gap greater than or equal to 3 eV, which is one of gallium nitride (GaN), titanium dioxide ($TiO_2$), aluminum nitride (AlN), silicon dioxide ($SiO_2$), zinc sulfide (ZnS), zinc oxide (ZnO), silicon carbide (SiC), aluminum gallium nitride (AlGaN), aluminum oxide ($Al_2O_3$), boron nitride (BN) or silicon nitride ($Si_3N_4$), or combinations thereof. Moreover, the trigger particles 5212, 5222 of the first and second thin-film layers 521, 522 in the beam antenna 5 could be organometallic particles, where a structure of the organometallic particle is R-M-X, R-M-R' or R-M-R, in which M is metal, R and R' could be a cycloalkyl group, an alkyl group, a heterocycle group or a carboxylic acid group, a alkyl halide group, an aromatic hydrocarbon group, and X is a halogen compound or an amine group. Moreover, M could be one of gold, nickel, tin, copper, palladium, silver or aluminium, or combinations thereof. In this way, the parasitic media and ohmic loss of the first and second radiating conductor units 53, 54 could be effectively decreased to improve the radiation efficiency of the beam antenna 5, so as to effectively increase the pattern coverage range of the far-field radiation beam of the beam antenna 5.

The trigger particles 5212, 5222 of the first and second thin-film layers 521, 522 in the beam antenna 5 could also be a chelation, which is formed from a metal chelated by a chelating agent. The chelanting agent is at least one of Ammonium Pyrrolidine Dithiocarbamate (APDC), Ehtylenediaminetetraacetic Acid (EDTA), Nitrilotri Actiate (NTA), N-N'-Bis (Carboxymethyl) Nitrotriacetate or Diethylenetriamine pentaacetic Acid (DTPA), and the metal could be one of gold, silver, copper, tin, aluminium, nickel or palladium, or combinations thereof. In this way, the parasitic media and ohmic loss of the first and second radiating conductor units 53, 54 can be effectively decreased to improve the radiation efficiency of the beam antenna 5, so as to effectively increase the pattern coverage range of the far-field radiation beam of the beam antenna 5.

Compared to the beam antenna 2, in the beam antenna 5, although a configuration direction of the second material layer 52, the first and the second thin-film layers 521, 522 and the first and second radiating conductor units 53, 54 is different to that of the beam antenna 2, the beam antenna 5 also effectively decreases parasitic media and ohmic loss of the first and second radiating conductor units 53, 54 by designing the weight percentage of the trigger particles 5212, 5222 and the insulating gels 5211, 5221 in the first and second thin-film layers 521, 522, so as to effectively improve the pattern coverage range of the far-field radiation beam of the beam antenna 5. The beam antenna 5 may also effectively decrease the parasitic media and ohmic loss of the first and second radiating conductor units 53, 54 through the thickness d1 and d2 of the first and second thin-film layers 521, 522, so as to improve the whole radiation efficiency of the beam antenna 5. Moreover, the beam antenna 5 may also enhance the directivity of the beam antenna 5 through the distance s between the first material layer 51 and the second material layer 52, so as to effectively decrease the transmission loss caused by the energy transmission conductor structure 55, and improve the maximum gain of the beam antenna 5. Therefore, the beam antenna 5 may also achieve the similar effect as that of the beam antenna 2.

The energy transmission conductor structure 55 of the beam antenna 5 is a bi-wire transmission line structure, which may effectively excite the beam antenna 5 to generate at least one resonant mode to cover operating frequencies of at least one communication system band. The energy transmission conductor structure 55 could also be one of a pogo-pin feed-in structure, a waveguide structure, a coaxial transmission line structure, a microstrip transmission line structure, a coplanar waveguide structure, a conductor elastic piece structure or a matching circuit or a combination thereof, which may all achieve the same effect in the beam antenna 5.

The signal source 511 of the beam antenna 5 is electrically coupled or connected to the first terminal 551 of the energy transmission conductor structure 55 through the matching circuit 56. However, the signal source 511 could also be electrically coupled or connected to the first terminal 551 of the energy transmission conductor structure 55 through one of a waveguide structure, a coaxial transmission line structure, a coplanar waveguide structure, a bi-wire transmission line structure, a pogo-pin feed-in structure, a conductor elastic piece structure or a microstrip transmission line structure or a combination thereof, which may all achieve the same effect in the beam antenna 5.

Moreover, in the beam antenna 5, the first radiating conductor unit 53 is electrically coupled to the second radiating conductor unit 54 through the coplanar waveguide structure 531. However, the first radiating conductor unit 53 may also be electrically coupled or connected to the second radiating conductor unit 54 through one of a waveguide structure, a microstrip transmission line structure, a slot structure, a bi-wire transmission line structure, a via-hole conducting structure, or a matching circuit or a combination thereof, which may all achieve the same effect in the beam antenna 5.

The first and second radiating conductor units 53, 54 in the beam antenna 5 may also have one of a patch structure, a short-circuit structure, a meandering structure, a slot structure, a slit structure or a gap structure or a combination thereof, which may all achieve the same effect in the beam antenna 5.

Figure 6:
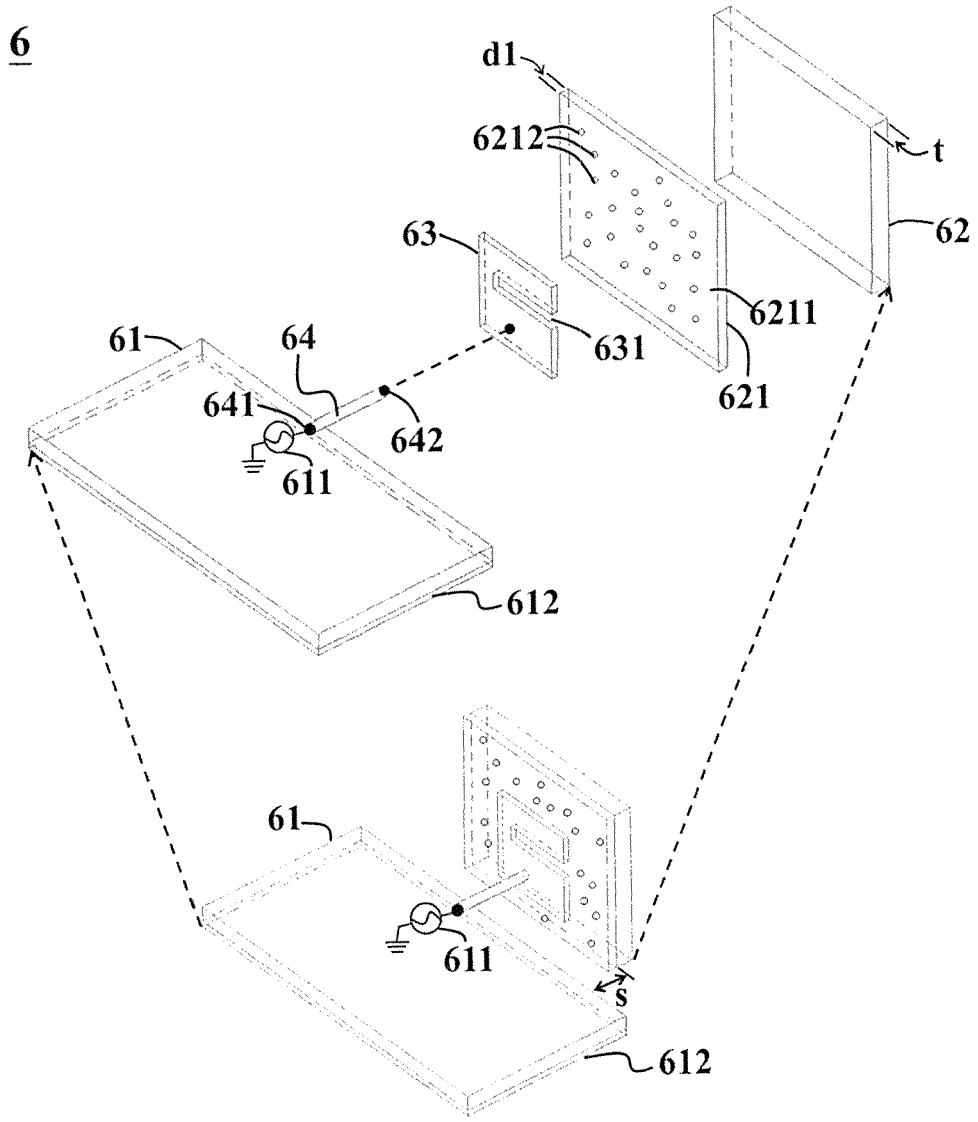
FIG. 6 is a structural schematic diagram of a beam antenna according to still another embodiment of the invention.

FIG. 6 is a structural schematic diagram of a beam antenna according to still another embodiment of the invention. As shown in FIG. 6, the beam antenna 6 includes a first material layer 61, a first conductor layer 612, a second material layer 62, at least one first thin-film layer 621, at least one first radiating conductor unit 63, and an energy transmission conductor structure 65. The first material layer 61 has a signal source 611 and the first conductor layer 612, where the first conductor layer 612 is adhered on a surface of the first material layer 61, and the signal source 611 is electrically coupled or connected to the first conductor layer 612. The second material layer 62 has the at least one first thin-film layer 621 adhered on a surface of the second material layer 62. The first thin-film layer 621 includes an insulating gel 6211 and a plurality of trigger particles 6212. The insulating gel 6211 is a macromolecular material. The trigger particles 6212 include at least one of organometallic particles, a metal chelate, and a semiconductor material with an energy gap greater than or equal to 3 eV. The trigger particles 6212 are adapted to be activated when irradiated by a laser energy, where a wavelength of the laser energy is between 430 and 1080 nm. The at least one first radiating conductor unit 63 is adhered on a surface of the first thin-film layer 621, and the first thin-film layer 621 is located between the first radiating conductor unit 63 and the second material layer 62. The at least one first radiating conductor unit 63 is a patch structure, and has a slit structure 631. The energy transmission conductor structure 64 is a pogo-pin feed-in structure, which is disposed between the first material layer 61 and the second material layer 62, and has a first terminal 641 and a second terminal 642. The first terminal 641 is electrically connected to the signal source 611, and the second terminal 642 is electrically connected to the first radiating conductor unit 63, and excites the beam antenna 6 to generate at least one resonant mode to cover operating frequencies of at least one communication system band. A gap distance of the slit structure 631 is smaller than 0.19 times of the wavelength of the minimum operating frequency of the lowest resonant mode generated by the beam antenna 6.

The beam antenna 6 adopts the specially designed first thin-film layer 621 and the first conductor layer 612 to improve the far-field radiation efficiency of the first radiating conductor unit 63, so as to improve the maximum gain of the beam antenna 6. The beam antenna 6 may also effectively decrease parasitic media and ohmic loss of the first radiating conductor unit 63 by designing a weight percentage of the trigger particles 6212 and the insulating gel 6211 in the first thin-film layer 621, so as to effectively improve the pattern coverage range of the far-field radiation beam of the beam antenna 6. The trigger particles 6212 may constitute 0.1-28 weight percentage of the insulating gel 6211 in the first thin-film layer 621 of the beam antenna 6, and the insulating gel 6211 of the first thin-film layer 621 may have a viscosity smaller than 9000 cP. A thickness t of the second material layer 62 is between 0.001-0.15 times of a wavelength of the minimum operating frequency of the lowest resonant mode generated by the beam antenna 6. A thickness d1 of the first thin-film layer 621 is between 10-290 μm. In this way, the parasitic media and ohmic loss of the first radiating conductor unit 63 could be effectively decreased to improve the whole radiation efficiency of the beam antenna 6, so as to effectively increase the pattern coverage range of the far-field radiation beam of the beam antenna 6. A distance s between the first material layer 61 and the second material layer 62 is smaller than 0.39 times of the wavelength of the minimum operating frequency of the lowest resonant mode generated by the beam antenna 6. In this way, the directivity of the beam antenna 6 is enhanced to effectively decrease a transmission loss caused by the energy transmission conductor structure 64, so as to improve the maximum gain of the beam antenna 6.

The trigger particles 6212 of the first thin-film layer 621 in the beam antenna 6 could be a semiconductor material with an energy gap greater than or equal to 3 eV, which is one of gallium nitride (GaN), titanium dioxide ($TiO_2$), aluminum nitride (AlN), silicon dioxide ($SiO_2$), zinc sulfide (ZnS), zinc oxide (ZnO), silicon carbide (SiC), aluminum gallium nitride (AlGaN), aluminum oxide ($Al_2O_3$), boron nitride (BN) or silicon nitride ($Si_3N_4$), or combinations thereof. Moreover, the trigger particles 6212 of the first thin-film layer 621 in the beam antenna 6 could be organometallic particles, where a structure of the organometallic particle is R-M-X, R-M-R' or R-M-R, in which M is metal, R and R' could be a cycloalkyl group, an alkyl group, a heterocycle group or a carboxylic acid group, a alkyl halide group, an aromatic hydrocarbon group, and X is a halogen compound or an amine group. Moreover, M could be one of gold, nickel, tin, copper, palladium, silver or aluminium, or combinations thereof. In this way, the parasitic media and ohmic loss of the first radiating conductor unit 63 can be effectively decreased to improve the radiation efficiency of the beam antenna 6, so as to effectively increase the pattern coverage range of the far-field radiation beam of the beam antenna 6.

The trigger particles 6212 of the first thin-film layer 621 in the beam antenna 6 could also be a chelation, which is formed from a metal chelated by a chelating agent. The chelanting agent is at least one of Ammonium Pyrrolidine Dithiocarbamate (APDC), Ehtylenediaminetetraacetic Acid (EDTA), Nitrilotri Actiate (NTA), N-N'-Bis (Carboxymethyl) Nitrotriacetate or Diethylenetriamine pentaacetic Acid (DTPA), and the metal is one of gold, silver, copper, tin, aluminium, nickel or palladium, or combinations thereof. In this way, the parasitic media and ohmic loss of the first radiating conductor unit 63 could be effectively decreased to improve the radiation efficiency of the beam antenna 6, so as to effectively increase the pattern coverage range of the far-field radiation beam of the beam antenna 6.

Compared to the beam antenna 4, the first radiating conductor unit 63 of the beam antenna 6 is a patch structure, and has the slot structure 631. However, the beam antenna 6 also effectively decreases parasitic media and ohmic loss of the first radiating conductor unit 63 by designing the weight percentage of the trigger particles 6212 and the insulating gel 6211 in the first thin-film layer 621, so as to effectively improve the pattern coverage range of the far-field radiation beam of the beam antenna 6. The beam antenna 6 may also effectively decrease the parasitic media and ohmic loss of the first radiating conductor unit 63 through the thickness d1 of the first thin-film layer 621, so as to improve the whole radiation efficiency of the beam antenna 6. Moreover, the beam antenna 6 may also enhance the directivity of the beam antenna 6 through the distance s between the first material layer 61 and the second material layer 62, so as to effectively decrease the transmission loss caused by the energy transmission conductor structure 64, and improve the maximum gain of the beam antenna 6. Therefore, the beam antenna 6 may also achieve the similar effect as that of the beam antenna 4.

The energy transmission conductor structure 64 of the beam antenna 6 is a pogo-pin feed-in structure, and the energy transmission conductor structure 64 may effectively excite the beam antenna 6 to generate at least one resonant mode to cover operating frequencies of at least one communication system band. The energy transmission conductor structure 64 could also be one of a waveguide structure, a coaxial transmission line structure, a microstrip transmission line structure, a coplanar waveguide structure, a bi-wire transmission line structure, a conductor elastic piece structure or a matching circuit or a combination thereof, which may all achieve the same effect in the beam antenna 6.

Moreover, the signal source 611 of the beam antenna 6 may also be electrically coupled or connected to the first terminal 641 of the energy transmission conductor structure 64 through one of a waveguide structure, a coaxial transmission line structure, a microstrip transmission line structure, a coplanar waveguide structure, a bi-wire transmission line structure, a pogo-pin feed-in structure, a conductor elastic piece structure or a matching circuit or a combination thereof, which may all achieve the same effect in the beam antenna 6.

Moreover, the first radiating conductor unit 63 in the beam antenna 6 may also have one of a patch structure, a short-circuit structure, a meandering structure, a slot structure, a slit structure or a gap structure or a combination thereof, which may all achieve the same effect in the beam antenna 6.

Figure 7:
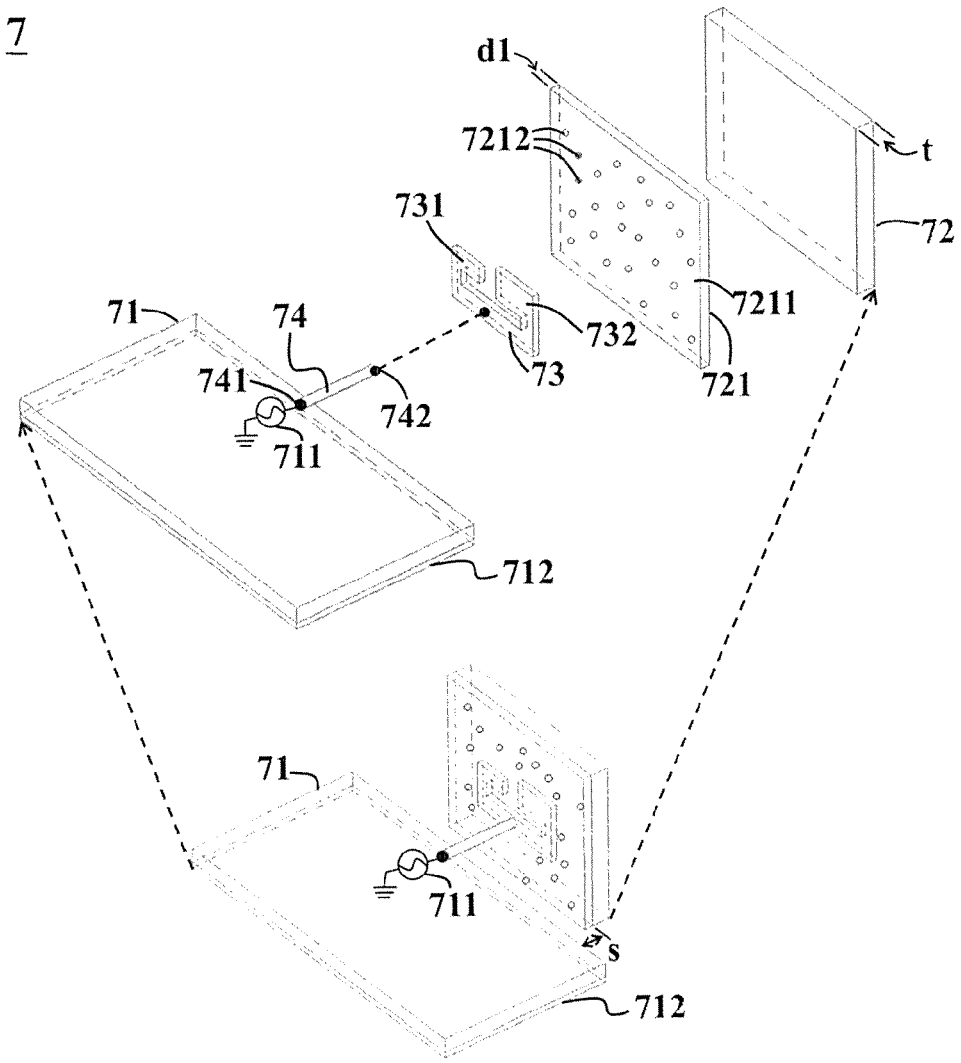
FIG. 7 is a structural schematic diagram of a beam antenna according to still another embodiment of the invention.

FIG. 7 is a structural schematic diagram of a beam antenna according to still another embodiment of the invention. As shown in FIG. 7, the beam antenna 7 includes a first material layer 71, a first conductor layer 712, a second material layer 72, at least one first thin-film layer 721, at least one first radiating conductor unit 73, and an energy transmission conductor structure 74. The first material layer 71 has a signal source 711 and the first conductor layer 712, where the first conductor layer 712 is adhered on a surface of the first material layer 71, and the signal source 711 is electrically coupled or connected to the first conductor layer 712. The second material layer 72 has the at least one first thin-film layer 721 adhered on a surface of the second material layer 72. The first thin-film layer 721 includes an insulating gel 7211 and a plurality of trigger particles 7212. The insulating gel 7211 is a macromolecular material. The trigger particles 7212 include at least one of organometallic particles, a chelation, and a semiconductor material with an energy gap greater than or equal to 3 eV. The trigger particles 7212 are adapted to be activated when irradiated by a laser energy, where a wavelength of the laser energy is between 430 and 1080 nm. The at least one first radiating conductor unit 73 is adhered on a surface of the first thin-film layer 721, and the first thin-film layer 721 is located between the first radiating conductor unit 73 and the second material layer 72. The at least one first radiating conductor unit 73 has a meandering structure 731 and a meandering structure 732. The energy transmission conductor structure 74 is a pogo-pin feed-in structure, which is disposed between the first material layer 71 and the second material layer 72, and has a first terminal 741 and a second terminal 742. The first terminal 741 is electrically connected to the signal source 711, and the second terminal 742 is electrically connected to the first radiating conductor unit 73, and excites the beam antenna 7 to generate at least one resonant mode to cover operating frequencies of at least one communication system band. A path length of the meandering structure 731 and the meandering structure 732 is less than 0.39 times of the wavelength of the minimum operating frequency of the lowest resonant mode generated by the beam antenna 7.

The beam antenna 7 adopts the specially designed first thin-film layer 721 and the first conductor layer 712 to improve the far-field radiation efficiency of the first radiating conductor unit 73, so as to improve the maximum gain of the beam antenna 7. The beam antenna 7 may also effectively decrease parasitic media and ohmic loss of the first radiating conductor unit 73 by designing a weight percentage of the trigger particles 7212 and the insulating gel 7211 in the first thin-film layer 721, so as to effectively improve the pattern coverage range of the far-field radiation beam of the beam antenna 7. The trigger particles 7212 may constitute 0.1-28 weight percentage of the insulating gel 7211 in the first thin-film layer 721 of the beam antenna 7, and the insulating gel 7211 of the first thin-film layer 721 may have a viscosity smaller than 9000 cP. A thickness t of the second material layer 72 is between 0.001-0.15 times of a wavelength of the minimum operation frequency of the resonant mode generated by the beam antenna 7. A thickness d1 of the first thin-film layer 721 is between 10-290 In this way, the parasitic media and ohmic loss of the first radiating conductor unit 73 could be effectively decreased to improve the whole radiation efficiency of the beam antenna 7, so as to effectively increase the pattern coverage range of the far-field radiation beam of the beam antenna 7. A distance s between the first material layer 71 and the second material layer 72 is smaller than 0.39 times of the wavelength of the minimum operating frequency of the lowest resonant mode generated by the beam antenna 7. In this way, the radiation directivity of the beam antenna 7 is enhanced to effectively decrease a transmission loss caused by the energy transmission conductor structure 74, so as to improve the maximum gain of the beam antenna 7.

The trigger particles 7212 of the first thin-film layer 721 in the beam antenna 6 could be a semiconductor material with an energy gap greater than or equal to 3 eV, which is one of gallium nitride (GaN), titanium dioxide ($TiO_2$), aluminum nitride (AlN), silicon dioxide ($SiO_2$), zinc sulfide (ZnS), zinc oxide (ZnO), silicon carbide (SiC), aluminum gallium nitride (AlGaN), aluminum oxide ($Al_2O_3$), boron nitride (BN) or silicon nitride ($Si_3N_4$), or combinations thereof. Moreover, the trigger particles 7212 of the first thin-film layer 721 in the beam antenna 7 could be organometallic particles, where a structure of the organometallic particle is R-M-X, R-M-R' or R-M-R, in which M is metal, R and R' are a cycloalkyl group, an alkyl group, a heterocycle group or a carboxylic acid group, a alkyl halide group, an aromatic hydrocarbon group, and X is a halogen compound or an amine group. Moreover, M could be one of gold, nickel, tin, copper, palladium, silver or aluminium, or combinations thereof. In this way, the parasitic media and ohmic loss of the first radiating conductor unit 73 could be effectively decreased to improve the radiation efficiency of the beam antenna 7, so as to effectively increase the pattern coverage range of the far-field radiation beam of the beam antenna 7.

The trigger particles 7212 of the first thin-film layer 721 in the beam antenna 7 could also be a chelation, which is formed from a metal chelated by a chelating agent. The chelating agent could be at least one of Ammonium Pyrrolidine Dithiocarbamate (APDC), Ehtylenediaminetetraacetic Acid (EDTA), Nitrilotri Actiate (NTA), N-N'-Bis (Carboxymethyl) Nitrotriacetate or Diethylenetriamine pentaacetic Acid (DTPA), and the metal is one of gold, silver, copper, tin, aluminium, nickel or palladium, or combinations thereof. In this way, the parasitic media and ohmic loss of the first radiating conductor unit 73 could be effectively decreased to improve the radiation efficiency of the beam antenna 7, so as to effectively increase the pattern coverage range of the far-field radiation beam of the beam antenna 7.

Compared to the beam antenna 4, the first radiating conductor unit 73 of the beam antenna 7 has the meandering structure 731 and the meandering structure 732. However, the beam antenna 7 also effectively decreases parasitic media and ohmic loss of the first radiating conductor unit 73 by designing the weight percentage of the trigger particles 7212 and the insulating gel 7211 in the first thin-film layer 721, so as to effectively improve the pattern coverage range of the far-field radiation beam of the beam antenna 7. The beam antenna 7 may also effectively decrease the parasitic media and ohmic loss of the first radiating conductor unit 73 through the thickness d1 of the first thin-film layer 721, so as to improve the whole radiation efficiency of the beam antenna 7. Moreover, the beam antenna 7 may also enhance the directivity of the beam antenna 7 through the distance s between the first material layer 71 and the second material layer 72, so as to effectively decrease the transmission loss caused by the energy transmission conductor structure 74, and improve the maximum gain of the beam antenna 7. Therefore, the beam antenna 7 may also achieve the similar effect as that of the beam antenna 4.

The energy transmission conductor structure 74 of the beam antenna 7 is a pogo-pin feed-in structure, and the energy transmission conductor structure 74 may effectively excite the beam antenna 7 to generate at least one resonant mode to cover operating frequencies of at least one communication system band. The energy transmission conductor structure 74 could also be one of a waveguide structure, a coaxial transmission line structure, a microstrip transmission line structure, a coplanar waveguide structure, a bi-wire transmission line structure, a conductor elastic piece structure or a matching circuit or a combination thereof, which may all achieve the same effect in the beam antenna 7.

Moreover, the signal source 711 of the beam antenna 7 may also be electrically coupled or connected to the first terminal 741 of the energy transmission conductor structure 74 through one of a waveguide structure, a coaxial transmission line structure, a microstrip transmission line structure, a coplanar waveguide structure, a bi-wire transmission line structure, a pogo-pin feed-in structure, a conductor elastic piece structure or a matching circuit or a combination thereof, which may all achieve the same effect in the beam antenna 7.

Moreover, the first radiating conductor unit 73 in the beam antenna 7 may also have one of a patch structure, a short-circuit structure, a meandering structure, a slot structure, a slit structure or a gap structure or a combination thereof, which may all achieve the same effect in the beam antenna 7.

The resonant mode generated by the beam antenna could be designed to cover operating frequencies of a wireless wide area network (WWAN) system, a wireless personal area network (WPAN) system, a wireless local area network (WLAN) system, a multi-input multi-output (MIMO) system, a digital television broadcasting (DTV) system, a global positioning system (GPS), a satellite communication system and a beamforming antenna array system or other wireless or mobile communication systems.

Figure 8A:
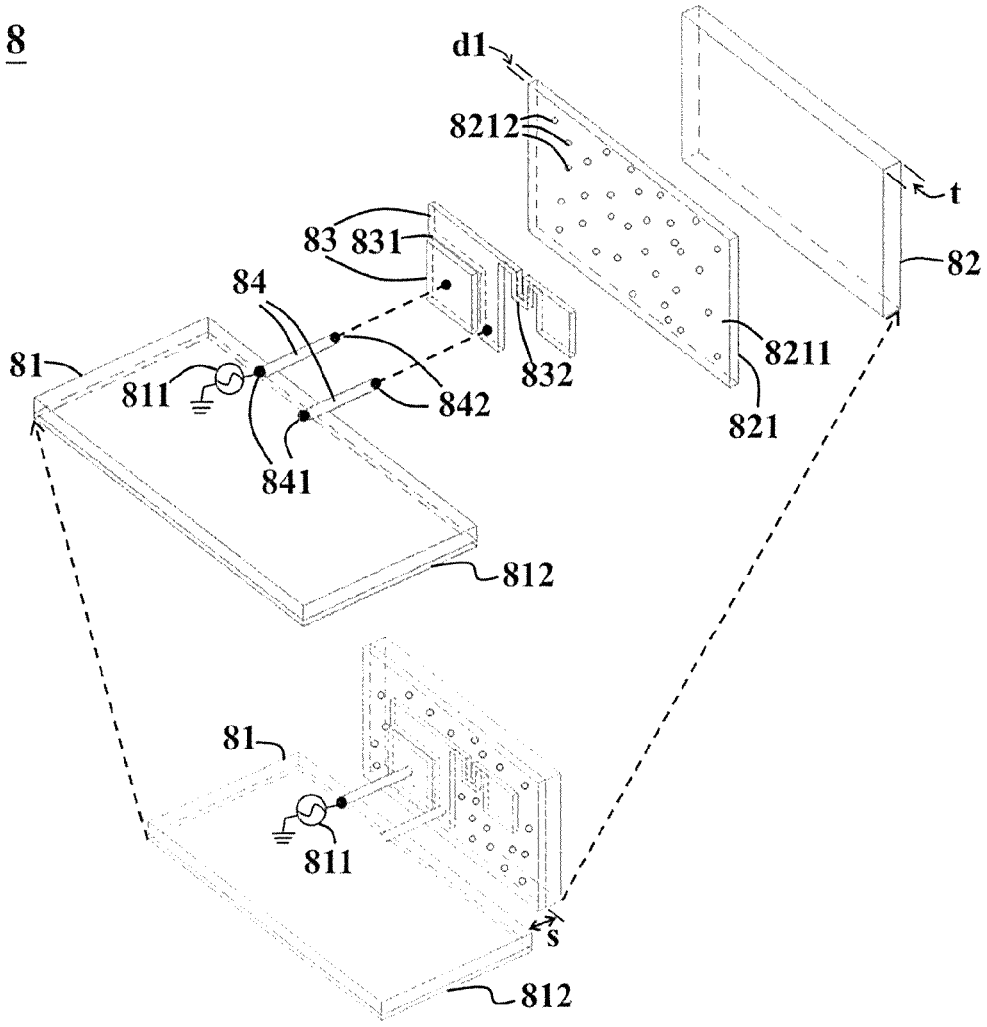
FIG. 8A is a structural schematic diagram of a beam antenna according to still another embodiment of the invention.

FIG. 8A is a structural schematic diagram of a beam antenna according to still another embodiment of the invention. As shown in FIG. 8A, the beam antenna 8 includes a first material layer 81, a first conductor layer 812, a second material layer 82, at least one first thin-film layer 821, at least one first radiating conductor unit 83, and an energy transmission conductor structure 84. The first material layer 81 has a signal source 811 and the first conductor layer 812, where the first conductor layer 812 is adhered on a surface of the first material layer 81, and the signal source 811 is electrically coupled or connected to the first conductor layer 812. The second material layer 82 has the at least one first thin-film layer 821 adhered on a surface of the second material layer 82. The first thin-film layer 821 includes an insulating gel 8211 and a plurality of trigger particles 8212. The insulating gel 8211 is a macromolecular material. The trigger particles 8212 include at least one of organometallic particles, a chelation, and a semiconductor material with an energy gap greater than or equal to 3 eV. The trigger particles 8212 are adapted to be activated when irradiated by a laser energy, where a wavelength of the laser energy is between 430 and 1080 nm. The at least one first radiating conductor unit 83 is adhered on a surface of the first thin-film layer 821, and the first thin-film layer 821 is located between the first radiating conductor unit 83 and the second material layer 82. The at least one first radiating conductor unit 83 has a slot-fissure structure 831 and a meander structure 832. The energy transmission conductor structure 84 is a pogo-pin feed-in structure, which is disposed between the first material layer 81 and the second material layer 82, and has a first terminal 841 and a second terminal 842. The first terminal 841 is electrically connected to the signal source 811, and the second terminal 842 is electrically connected to the first radiating conductor unit 83, and excites the beam antenna 8 to generate at least one resonant mode to cover operating frequencies of at least one communication system band.

Figure 8B:
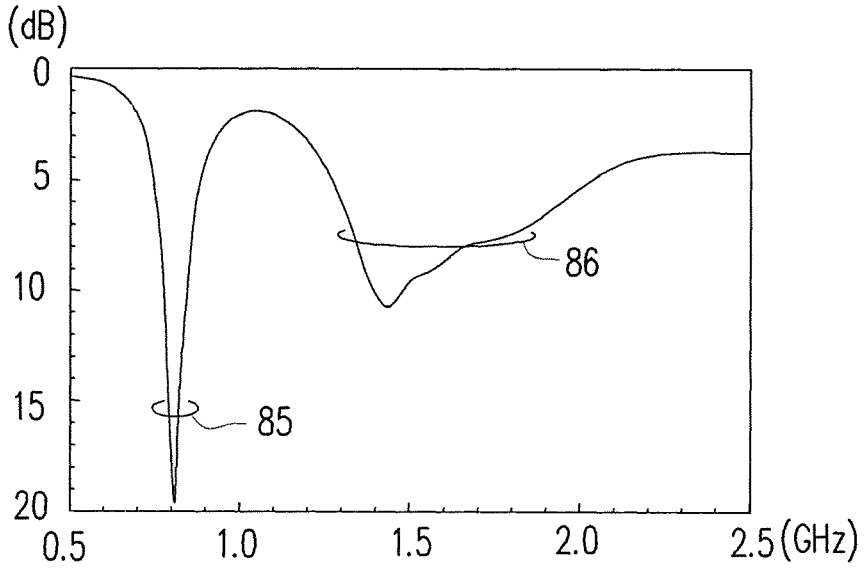
FIG. 8B is a return loss diagram of the beam antenna of FIG. 8A.

FIG. 8B is a return loss diagram of the beam antenna of FIG. 8A. As shown in FIG. 8B, the beam antenna 8 generates a resonant mode 85 and a resonant mode 86 to cover operating frequencies of a global system for mobile communications 850 (GSM 850) system band and GSM 1800/1900 system bands, respectively. FIG. 8B is only an example for the resonant modes generated by the beam antenna 8 covering the operating frequencies of at least one communication system band, which is not used for limiting the implementation of the invention. The resonant modes generated by the beam antenna 8 can also be designed to cover operating frequencies of a wireless wide area network (WWAN) system, a wireless personal area network (WPAN) system, a wireless local area network (WLAN) system, a multi-input multi-output (MIMO) system, a digital television broadcasting (DTV) system, a global positioning system (GPS), a satellite communication system and a beamforming antenna array system or other wireless or mobile communication systems.

The beam antenna 8 adopts the specially designed first thin-film layer 821 and the first conductor layer 812 to improve the far-field radiation efficiency of the first radiating conductor unit 83, so as to improve the maximum gain of the beam antenna 8. The beam antenna 8 may also effectively decrease parasitic media and ohmic loss of the first radiating conductor unit 83 by designing a weight percentage of the trigger particles 8212 and the insulating gel 8211 in the first thin-film layer 821, so as to effectively improve the pattern coverage range of the far-field radiation beam of the beam antenna 8. The trigger particles 8212 may constitute 0.1-28 weight percentage of the insulating gel 8211 in the first thin-film layer 821 of the beam antenna 8, and the insulating gel 8211 of the first thin-film layer 821 may have a viscosity less than 9000 cP. A thickness t of the second material layer 82 is between 0.001-0.15 times of a wavelength of the minimum operating frequency of the lowest resonant mode generated by the beam antenna 8. A thickness d1 of the first thin-film layer 821 is between 10-290 μm. In this way, the parasitic media and ohmic loss of the first radiating conductor unit 83 could be effectively decreased to improve the whole radiation efficiency of the beam antenna 8, so as to effectively increase the pattern coverage range of the far-field radiation beam of the beam antenna 8. A distance s between the first material layer 81 and the second material layer 82 is smaller than 0.39 times of the wavelength of the minimum operating frequency of the lowest resonant mode generated by the beam antenna 8. In this way, the directivity of the beam antenna 8 is enhanced to effectively decrease a transmission loss caused by the energy transmission conductor structure 84, so as to improve the maximum gain of the beam antenna 8.

The trigger particles 8212 of the first thin-film layer 821 in the beam antenna 8 can be a semiconductor material with an energy gap greater than or equal to 3 eV, which is one of gallium nitride (GaN), titanium dioxide ($TiO_2$), aluminum nitride (AlN), silicon dioxide ($SiO_2$), zinc sulfide (ZnS), zinc oxide (ZnO), silicon carbide (SiC), aluminum gallium nitride (AlGaN), aluminum oxide ($Al_2O_3$), boron nitride (BN) or silicon nitride ($Si_3N_4$), or combinations thereof. Moreover, the trigger particles 8212 of the first thin-film layer 821 in the beam antenna 8 could be organometallic particles, where a structure of the organometallic particle is R-M-X, R-m-R' or R-M-R, in which M is metal, R and R' are a cycloalkyl group, an alkyl group, a heterocycle group or a carboxylic acid group, a alkyl halide group, an aromatic hydrocarbon group, and X is a halogen compound or an amine group. Moreover, M could be one of gold, nickel, tin, copper, palladium, silver or aluminium, or combinations thereof. In this way, the parasitic media and ohmic loss of the first radiating conductor unit 83 could be effectively decreased to improve the radiation efficiency of the beam antenna 8, so as to effectively increase the pattern coverage range of the far-field radiation beam of the beam antenna 8.

The trigger particles 8212 of the first thin-film layer 821 in the beam antenna 8 could also be a chelation, which is formed from a metal chelated by a chelating agent. The chelating agent is at least one of Ammonium Pyrrolidine Dithiocarbamate (APDC), Ehtylenediaminetetraacetic Acid (EDTA), Nitrilotri Actiate (NTA), N-N'-Bis (Carboxymethyl) Nitrotriacetate or Diethylenetriamine pentaacetic Acid (DTPA), and the metal could be one of gold, silver, copper, tin, aluminium, nickel or palladium, or combinations thereof. In this way, the parasitic media and ohmic loss of the first radiating conductor unit 83 could be effectively decreased to improve the radiation efficiency of the beam antenna 8, so as to effectively increase the pattern coverage range of the far-field radiation beam of the beam antenna 8.

Compared to the beam antenna 4, the first radiating conductor unit 83 of the beam antenna 8 has the slit structure 831 and the meandering structure 832. However, the beam antenna 8 also effectively decreases parasitic media and ohmic loss of the first radiating conductor unit 83 by designing the weight percentage of the trigger particles 8212 and the insulating gel 8211 in the first thin-film layer 821, so as to effectively improve the pattern coverage range of the far-field radiation beam of the beam antenna 8. The beam antenna 8 may also effectively decrease the parasitic media and ohmic loss of the first radiating conductor unit 83 through the thickness d1 of the first thin-film layer 821, so as to improve the whole radiation efficiency of the beam antenna 8. Moreover, the beam antenna 8 may also enhance the directivity of the beam antenna 8 through the distance s between the first material layer 81 and the second material layer 82, so as to effectively decrease the transmission loss caused by the energy transmission conductor structure 84, and improve the maximum gain of the beam antenna 8. Therefore, the beam antenna 8 may also achieve the similar effect as that of the beam antenna 4.

The energy transmission conductor structure 84 of the beam antenna 8 is a pogo-pin feed-in structure, and the energy transmission conductor structure 84 may effectively excite the beam antenna 8 to generate at least one resonant mode to cover operating frequencies of at least one communication system band. The energy transmission conductor structure 84 could also be one of a waveguide structure, a coaxial transmission line structure, a microstrip transmission line structure, a coplanar waveguide structure, a bi-wire transmission line structure, a conductor elastic piece structure or a matching circuit or a combination thereof, which may all achieve the same effect in the beam antenna 8.

Moreover, the signal source 811 of the beam antenna 8 may also be electrically coupled or connected to the first terminal 841 of the energy transmission conductor structure 84 through one of a waveguide structure, a coaxial transmission line structure, a microstrip transmission line structure, a coplanar waveguide structure, a bi-wire transmission line structure, a pogo-pin feed-in structure, a conductor elastic piece structure or a matching circuit or a combination thereof, which may all achieve the same effect in the beam antenna 8.

Moreover, the first radiating conductor unit 83 in the beam antenna 8 may also have one of a patch structure, a short-circuit structure, a meandering structure, a slot structure, a slit structure or a gap structure or a combination thereof, which may all achieve the same effect in the beam antenna 8.

In summary, the beam antenna of the disclosure may adopt the specially designed thin-film layer and conductor layer to improve the far-field radiation efficiency of the beam antenna, so as to improve the maximum gain of the beam antenna. The beam antenna also adopts specially designed trigger particles of the thin-film layer to effectively decrease parasitic media and ohmic loss of the beam antenna, so as to effectively improve a pattern coverage range of a far-field radiation beam of the beam antenna.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A beam antenna, comprising:

a first material layer, having a signal source and a first conductor layer, wherein the first conductor layer is adhered on a surface of the first material layer, and the signal source is electrically coupled or connected to the first conductor layer;

a second material layer, having at least one first thin-film layer, wherein the first thin-film layer is adhered on a surface of the second material layer, and the first thin-film layer comprises:

an insulating gel, composed of a macromolecular material; and a plurality of trigger particles, comprising at least one of organometallic particles, a chelation, and a semiconductor material with an energy gap greater than or equal to 3 electron-volts (eV), and adapted to be activated when irradiated by a laser energy, wherein a wavelength of the laser energy is between 430 and 1080 nm;

at least one first radiating conductor unit, adhered on a surface of the first thin-film layer, wherein the first thin-film layer is located between the first radiating conductor unit and the second material layer; and an energy transmission conductor structure, disposed between the first material layer and the second material layer, and having a first terminal and a second terminal, wherein the first terminal is electrically coupled or connected to the signal source, and the second terminal is electrically coupled or connected to the first radiating conductor unit, and excites the beam antenna to generate at least one resonant mode to cover operating frequencies of at least one communication system band.

2. The beam antenna as claimed in claim 1, wherein the trigger particles of the first thin-film layer are a semiconductor material with an energy gap greater than or equal to 3 eV, and the semiconductor material is one of gallium nitride (GaN), titanium dioxide ($TiO_2$), aluminum nitride (AlN), silicon dioxide ($SiO_2$), zinc sulfide (ZnS), zinc oxide (ZnO), silicon carbide (SiC), aluminum gallium nitride (AlGaN), aluminum oxide ($Al_2O_3$), boron nitride (BN) or silicon nitride ($Si_3N_4$), or combinations thereof.

3. The beam antenna as claimed in claim 1, wherein the trigger particles of the first thin-film layer are organometallic particles, and a structure of the organometallic particle is R-M-X, R-M-R' or R-M-R, in which M is metal, R and R' are a cycloalkyl group, an alkyl group, a heterocycle group or a carboxylic acid group, a alkyl halide group, an aromatic hydrocarbon group, X is a halogen compound or an amine group, and M is one of gold, nickel, tin, copper, palladium, silver or aluminium, or combinations thereof.

4. The beam antenna as claimed in claim 1, wherein the trigger particles of the first thin-film layer are a chelation, and the trigger particles are formed from a metal chelated by a chelating agent, the chelating agent is at least one of Ammonium Pyrrolidine Dithiocarbamate (APDC), Ehtylenediaminetetraacetic Acid (EDTA), Nitrilotri Actiate (NTA), N-N'-Bis (Carboxymethyl) Nitrotriacetate or Diethylenetriamine pentaacetic Acid (DTPA), and the metal is one of gold, silver, copper, tin, aluminium, nickel or palladium, or combinations thereof.

5. The beam antenna as claimed in claim 1, wherein the energy transmission conductor structure is one of a waveguide structure, a coaxial transmission line structure, a microstrip transmission line structure, a coplanar waveguide structure, a bi-wire transmission line structure, a pogo-pin feed-in structure, a conductor elastic piece structure or a matching circuit or a combination thereof.

6. The beam antenna as claimed in claim 1, wherein the insulating gel of the first thin-film layer has a viscosity less than 9000 centipoises (cP), and t the trigger particles constitute 0.1-28 weight percentage of the insulating gel in the first thin-film layer.

7. The beam antenna as claimed in claim 1, wherein a distance between the first material layer and the second material layer is smaller than 0.39 times of a wavelength of a minimum operating frequency of the lowest resonant mode generated by the beam antenna.

8. The beam antenna as claimed in claim 1, wherein a thickness of the second material layer is between 0.001-0.15 times of a wavelength of a minimum operating frequency of the lowest resonant mode generated by the beam antenna.

9. The beam antenna as claimed in claim 1, wherein a thickness of the first thin-film layer is between 10-290 μm.

10. The beam antenna as claimed in claim 1, wherein the signal source is electrically coupled or connected to the first terminal of the energy transmission conductor structure through one of a waveguide structure, a coaxial transmission line structure, a microstrip transmission line structure, a coplanar waveguide structure, a bi-wire transmission line structure, a pogo-pin feed-in structure, a conductor elastic piece structure or a matching circuit or a combination thereof.

11. The beam antenna as claimed in claim 1, wherein the first radiating conductor unit has one of a patch structure, a short-circuit structure, a meandering structure, a slot structure, a slit structure or a gap structure or a combination thereof.

12. A beam antenna, comprising:

a first material layer, having a signal source and a first conductor layer, wherein the first conductor layer is adhered on a surface of the first material layer, and the signal source is electrically coupled or connected to the first conductor layer;

a second material layer, having a first thin-film layer and a second thin-film layer respectively adhered on different surfaces of the second material layer, wherein the second material layer is located between the first thin-film layer and the second thin-film layer, and the first thin-film layer and the second thin-film layers respectively comprise:

an insulating gel, composed of a macromolecular material; and a plurality of trigger particles, comprising at least one of organometallic particles, a chelation, and a semiconductor material with an energy gap greater than or equal to 3 eV, and adapted to be activated when irradiated by a laser energy, wherein a wavelength of the laser energy is between 430 and 1080 nm;

at least one first radiating conductor unit, adhered on a surface of the first thin-film layer, wherein the first thin-film layer is located between the first radiating conductor unit and the second material layer;

at least one second radiating conductor unit, adhered on a surface of the second thin-film layer, wherein the second thin-film layer is located between the second material layer and the second radiating conductor unit, and the first radiating conductor unit is electrically coupled or connected to the second radiating conductor unit; and an energy transmission conductor structure, disposed between the first material layer and the second material layer, and having a first terminal and a second terminal, wherein the first terminal is electrically coupled or connected to the signal source, and the second terminal is electrically coupled or connected to the first radiating conductor unit, and excites the beam antenna to generate at least one resonant mode to cover operating frequencies of at least one communication system band.

13. The beam antenna as claimed in claim 12, wherein the trigger particles of the first thin-film layer and the second thin-film layer are a semiconductor material with an energy gap greater than or equal to 3 eV, and the semiconductor material is one of gallium nitride (GaN), titanium dioxide ($TiO_2$), aluminum nitride (AlN), silicon dioxide ($SiO_2$), zinc sulfide (ZnS), zinc oxide (ZnO), silicon carbide (SiC), aluminum gallium nitride (AlGaN), aluminum oxide ($Al_2O_3$), boron nitride (BN) or silicon nitride ($Si_3N_4$) or combinations thereof.

14. The beam antenna as claimed in claim 12, wherein the trigger particles of the first thin-film layer and the second thin-film layer are organometallic particles, and a structure of the organometallic particle is R-M-X, R-M-R' or R-M-R, in which M is metal, R and R' are a cycloalkyl group, an alkyl group, a heterocycle group or a carboxylic acid group, a alkyl halide group, an aromatic hydrocarbon group, X is a halogen compound or an amine group, and M is one of gold, nickel, tin, copper, palladium, silver or aluminium, or combinations thereof.

15. The beam antenna as claimed in claim 12, wherein the trigger particles of the first thin-film layer and the second thin-film layer are a chelation, and the trigger particles are formed from a metal chelated by a chelating agent, the chelant is at least one of Ammonium Pyrrolidine Dithiocarbamate (APDC), Ehtylenediaminetetraacetic Acid (EDTA), Nitrilotri Actiate (NTA), N-N'-Bis (Carboxymethyl) Nitrotriacetate or Diethylenetriamine pentaacetic Acid (DTPA), and the metal is one of gold, silver, copper, tin, aluminium, nickel or palladium, or combinations thereof.

16. The beam antenna as claimed in claim 12, wherein the energy transmission conductor structure is one of a waveguide structure, a coaxial transmission line structure, a microstrip transmission line structure, a coplanar waveguide structure, a bi-wire transmission line structure, a pogo-pin feed-in structure, a conductor elastic piece structure or a matching circuit or a combination thereof.

17. The beam antenna as claimed in claim 12, wherein the insulating gels of the first thin-film layer and the second thin-film layer have a viscosity less than 9000 centipoises (cP), and the trigger particles constitute 0.1-28 weight percentage of the insulating gels in the first thin-film layer and the second thin-film layer.

18. The beam antenna as claimed in claim 12, wherein a distance between the first material layer and the second material layer is smaller than 0.39 times of a wavelength of a minimum operating frequency of the lowest resonant mode generated by the beam antenna.

19. The beam antenna as claimed in claim 12, wherein a thickness of the second material layer is between 0.001-0.15 times of a wavelength of a minimum operation frequency of the resonant mode generated by the beam antenna.

20. The beam antenna as claimed in claim 12, wherein a thickness of the first thin-film layer and the second thin-film layer is between 10-290 μm.

21. The beam antenna as claimed in claim 12, wherein the signal source is electrically coupled or connected to the first terminal of the energy transmission conductor structure through one of a waveguide structure, a coaxial transmission line structure, a microstrip transmission line structure, a coplanar waveguide structure, a bi-wire transmission line structure, a pogo-pin feed-in structure, a conductor elastic piece structure or a matching circuit or a combination thereof.

22. The beam antenna as claimed in claim 12, wherein the first radiating conductor unit is electrically coupled or connected to the second radiating conductor unit through one of a waveguide structure, a microstrip transmission line structure, a coplanar waveguide structure, a bi-wire transmission line structure, a slot structure, a via-hole conducting structure, or a matching circuit or a combination thereof.

23. The beam antenna as claimed in claim 12, wherein the first radiating conductor unit and the second radiating conductor unit have one of a patch structure, a short-circuit structure, a meandering structure, a slot structure, a slit structure or a gap structure or a combination thereof.

* * * * *